US008696399B2

(12) United States Patent
Mimlitch et al.

(10) Patent No.: US 8,696,399 B2
(45) Date of Patent: Apr. 15, 2014

(54) COMPONENTS FOR RAPIDLY CONSTRUCTING A USER-DEFINABLE APPARATUS

(71) Applicant: Innovation First, Inc., Greenville, TX (US)

(72) Inventors: Robert H. Mimlitch, Rowlett, TX (US); David Anthony Norman, Greenville, TX (US)

(73) Assignee: Innovation First, Inc., Greenville, TX (US)

( * ) Notice: Subject to any disclaimer, the term of this patent is extended or adjusted under 35 U.S.C. 154(b) by 0 days.

(21) Appl. No.: 13/760,652

(22) Filed: Feb. 6, 2013

(65) Prior Publication Data

US 2013/0149935 A1 Jun. 13, 2013

Related U.S. Application Data

(60) Continuation of application No. 12/116,099, filed on May 6, 2008, now abandoned, which is a division of application No. 10/355,585, filed on Dec. 31, 2002, now abandoned.

(60) Provisional application No. 60/345,791, filed on Dec. 31, 2001, provisional application No. 60/437,619, filed on Dec. 31, 2002.

(51) Int. Cl.
*A63H 33/00* (2006.01)

(52) U.S. Cl.
USPC ..... 446/85; 446/103; 446/113; 403/384

(58) Field of Classification Search
USPC ..... 446/85, 113, 114, 121; 403/384
See application file for complete search history.

(56) References Cited

U.S. PATENT DOCUMENTS

| | | | | | |
|---|---|---|---|---|---|
| 257,017 | A | | 4/1882 | Keller | |
| 487,540 | A | | 12/1892 | Ralph | |
| 526,590 | A | | 9/1894 | Terrill | |
| 833,187 | A | | 10/1906 | Ward | |
| 1,045,483 | A | | 11/1912 | Ward | |
| 1,171,816 | A | | 2/1916 | Wagner | |
| 1,589,827 | A | * | 6/1926 | Wessel | 446/113 |
| 1,760,638 | A | * | 5/1930 | Gilbert | 446/113 |
| 1,763,302 | A | | 6/1930 | Gilbert | |
| 1,789,896 | A | * | 1/1931 | Gilbert | 446/112 |
| 1,792,976 | A | * | 2/1931 | Gilbert | 446/112 |
| 1,815,632 | A | | 7/1931 | Pannier, Jr. | |
| 1,878,373 | A | | 9/1932 | Breeser | |

(Continued)

*Primary Examiner* — Alvin Hunter
*Assistant Examiner* — Urszula M Cegielnik
(74) *Attorney, Agent, or Firm* — Adam K. Sacharoff

(57) ABSTRACT

Mechanical and electromechanical components for rapidly constructing a user-definable apparatus may include components that are reconfigurable into other construction set components, and that have at least one demarcation defining adjacent segments thereof. The demarcations facilitate reconfiguration of the components to produce other construction set components. Openings to substantially prevent sharp edges from being formed during reconfiguration may be included in the components. An electromechanical drive assembly having an integrated speed control and operable to receive interchangeable, non-circular drive shafts may be provided. The electromechanical drive assembly may be configured to attach to and self-align relative to other construction set components. One or more of the components may be provided with openings through which the non-circular drive shafts may rotate. The drive shaft may be locked in relation to openings of components that, allow the drive shaft to rotate via a lock plate. A bearing plate may also be included.

7 Claims, 27 Drawing Sheets

(56) References Cited

U.S. PATENT DOCUMENTS

| | | | | | |
|---|---|---|---|---|---|
| 1,996,722 | A | | 4/1934 | Gilbert et al. | |
| 2,020,285 | A | * | 11/1935 | Becker, Sr. et al. | 403/384 |
| 2,542,172 | A | | 2/1951 | Andreas | |
| 2,636,297 | A | | 4/1953 | Johnson | |
| 2,649,806 | A | | 8/1953 | Monaghan | |
| 2,887,758 | A | | 5/1959 | Clark | |
| 3,092,470 | A | | 6/1963 | Ripling | |
| 3,157,474 | A | | 11/1964 | Hansson et al. | |
| 3,184,800 | A | * | 5/1965 | Nelson | 403/219 |
| 3,275,003 | A | | 9/1966 | Chamberlin | |
| 3,600,825 | A | | 8/1971 | Pearce | |
| 3,608,233 | A | | 9/1971 | Aoki | |
| 3,699,709 | A | * | 10/1972 | Schmidt | 446/113 |
| 3,744,094 | A | | 7/1973 | Bach | |
| 3,878,638 | A | | 4/1975 | Benjamin | |
| 3,986,318 | A | * | 10/1976 | McConnell | 403/384 |
| 3,987,580 | A | | 10/1976 | Ausnit | |
| 3,991,511 | A | | 11/1976 | McAllister et al. | |
| 3,992,956 | A | | 11/1976 | Fischer | |
| 4,077,562 | A | | 3/1978 | Ballin | |
| 4,095,368 | A | | 6/1978 | Saito | |
| 4,109,398 | A | | 8/1978 | Hida | |
| 4,170,083 | A | | 10/1979 | Freelander et al. | |
| 4,204,358 | A | | 5/1980 | Briggs | |
| 4,206,564 | A | | 6/1980 | Ogawa | |
| 4,214,024 | A | | 7/1980 | Jacobson | |
| 4,224,758 | A | | 9/1980 | Fischer | |
| 4,295,482 | A | * | 10/1981 | McMullen | 403/384 |
| 4,458,441 | A | * | 7/1984 | Bril | 446/113 |
| 4,571,202 | A | | 2/1986 | Diebold | |
| 4,600,355 | A | | 7/1986 | Johnson | |
| 4,690,656 | A | | 9/1987 | Friedman et al. | |
| 4,712,184 | A | | 12/1987 | Haugerud | |
| 4,813,903 | A | | 3/1989 | Furukawa et al. | |
| 5,154,615 | A | | 10/1992 | Joubert | |
| 5,261,851 | A | | 11/1993 | Siebert, Jr. | |
| 5,297,890 | A | * | 3/1994 | Commins | 403/384 |
| 5,385,472 | A | | 1/1995 | Mullin | |
| 5,411,428 | A | | 5/1995 | Orii et al. | |
| 5,611,691 | A | | 3/1997 | Poulain | |
| 5,702,283 | A | | 12/1997 | Watson et al. | |
| 5,738,558 | A | | 4/1998 | Zimmer et al. | |
| 5,742,486 | A | | 4/1998 | Yangkuai | |
| 5,779,515 | A | | 7/1998 | Chung | |
| 5,785,572 | A | | 7/1998 | Levy et al. | |
| 5,881,515 | A | * | 3/1999 | George | 446/113 |
| 5,913,706 | A | | 6/1999 | Glickman et al. | |
| 6,056,620 | A | | 5/2000 | Tobin | |
| 6,110,004 | A | | 8/2000 | McKinley et al. | |
| 6,123,482 | A | * | 9/2000 | Keller | 403/384 |
| 6,179,681 | B1 | | 1/2001 | Matos | |
| 6,298,629 | B1 | * | 10/2001 | Ador | 403/385 |
| 6,443,795 | B1 | | 9/2002 | Lin | |
| 6,443,796 | B1 | | 9/2002 | Shackelford | |
| 6,561,866 | B1 | | 5/2003 | Lee | |
| 6,595,825 | B1 | | 7/2003 | De Wilde | |
| 6,652,352 | B1 | | 11/2003 | MacArthur et al. | |
| 6,773,323 | B1 | | 8/2004 | Huang | |
| 7,104,863 | B2 | | 9/2006 | Mimlitch, III et al. | |
| 2002/0065016 | A1 | | 5/2002 | Huang | |

* cited by examiner

LEFT SIDE

RIGHT SIDE

SIDE VIEW

EDGE VIEW

SIDE VIEW

FRONT VIEW

SIDE VIEW

TOP VIEW

SIDE VIEW

SIDE VIEW

COMPONENTS FOR RAPIDLY CONSTRUCTING A USER-DEFINABLE APPARATUS

CROSS-REFERENCES TO RELATED APPLICATIONS

This application is a Continuation Application of U.S. patent application Ser. No. 12/116,099 filed May 6, 2008, which is a Divisional Application of U.S. patent application Ser. No. 10/335,585 filed Dec. 31, 2002 now abandoned, and which claims priority from Provisional Application 60/437,619 filed Dec. 31, 2002 and claims priority from Provisional Application 60/345,791 also filed Dec. 31, 2002; all of which are incorporated herein by reference in its entirety.

BACKGROUND OF THE INVENTION

The principles of the present invention generally relate to a construction set, and, more specifically, but not by way of limitation, to a construction set having construction set components designed to be alterable for use in constructing a user-definable apparatus.

The original erector set was filed for patent in 1901 and issued in 1906. Since that time, erector sets have more or less remained the same. The erector set generally includes fixed steed parts having fixed geometry and fixed coupling locations. The erector set includes parts that have circular holes that are utilized to couple various mechanical parts together. The erector set has and continues to be generally utilized as a toy for children to construct structures that typically are incapable of handling dynamic stresses and loads. For example, a structure constructed from the erector set is typically incapable of being utilized to perform specific tasks that, include heavy lifting.

The original erector set elements, while useful in terms of producing structures of fixed shapes and sizes, do not allow for atypical shapes and sizes of structures. One reason is that the components include holes located on the half pitch spacing. A second reason that atypical shapes and sizes of structures are prevented includes a limited number of structural elements or parts provided in a set and, therefore, a limited design of structures are capable of being formed. Additionally, the erector set does not include a wide variety of coupling elements to provide structurally sound, moveable joints for the structural elements. Further yet, the parts provided in the erector set typically are incapable of easily being reshaped and/or resized beyond their originally provided form.

Newer erector sets and add-ons to the original erector set provide for motors that may be utilized to add functionality to the structures that are created. However, the motors that are provided are generally not overly useful due to the power of the motors being low and the structural integration between the motor and the structural elements being inadequate. The motors that are provided generally have limited motion control (e.g., fixed speed and limited torque range). In addition, the motor provided typically includes a round shaft extending from the motor, where a set screw is generally required to couple the shaft to a mechanical element. Alternatively, a D-shaped shaft is provided with the erector set. However, the D-shaped shaft is problematic in that coupling the shaft to the mechanical elements required the use of additional structural coupling components. Also, both of these shaft types are problematic in that transferring torque of any magnitude is difficult to impossible simply because of interfacing capability between the shaft and structural elements. Therefore, dynamic loads and stresses of more than insignificant levels result in an utter failure of the drive capability of the motor.

In addition to the motor shaft coupling problems, the coupling of the motor to the structural elements provided in the erector set is problematic due to the motor housing not having adequate structural elements. Generally, those who want to attach the motor to the structural elements have to produce an ad hoc coupling structure. In other words, conventional erector sets do not provide an adequate number and type of coupling components for a motor housing to be connected or fastened to a structure. Because of the heretofore mentioned problems of the erector components lacking the ability to handle dynamic loads and stresses, attaching a motor to a conventional erector set structure, the overall structure tends to collapse and fall apart upon the occurrence of a dynamic load or stress of even minor magnitude. The user is therefore forced to reconstruct the structure on a frequent basis. Although gears, chains, and other translational devices are provided in conventional erector sets, the chains, for example, are inadequate for being utilized to drive loads of functional capacity.

Modern educational systems have begun to instruct students in the art of building dynamic structures, such as those used in robot competitions. In fact, governments have begun to require that science, physics, and mathematics classes include the use of robotic and mechanical devices to display practical aspects of theoretical principles. Because the educational systems are required to produce these devices, and because of the failure of the erector sets in the past to address practical implementations of these types of structures in robotics, rapid machine prototyping kit that is not limited by fixed structural components, inadequate coupling components, low powered motors, non-dynamic capacity drive systems, and structural components capable of forming dynamically, structurally sound structures is needed.

SUMMARY OF THE INVENTION

To overcome the problems of construction set components being difficult or substantially impossible to alter so as to produce construction set components, components that are designed to be alterable may be provided to allow for construction of a user-definable apparatus. Because the construction set components designed may be designed to be alterable, rapid prototyping of a user-definable apparatus may be performed by a user. The construction set components designed to be altered may include demarcations, such as indentations, that define segments of the construction set components. Such construction set components may include bars, plates, and gussets, for example. The demarcations may facilitate altering of the component to form at least one different construction set component. By being able to produce a different construction set component, the user may construct an infinite number of apparatus from the construction set that includes the alterable components.

The construction set may include a variety of other construction set components that provide for safely, rapidly prototyping a user-definable apparatus. In terms of safety, the components may have a configuration with substantially non-sharp corners to substantially eliminate risk of injury to the user or objects. In one embodiment, the corners may be chamfered. Alternatively, the corners may be rounded. In terms of components for rapid prototyping, in addition to or in combination with the construction set components including demarcations, the components may include openings configured to produce substantially no sharp edges in the event of the component being severed at the opening. Further, the components may include slotted bars and angles to allow a user to construct an apparatus in non-regular spacing intervals. Additionally, gussets with various configurations and openings may be included in the construction set to allow for the user to form joints with structural integrity. Fasteners configured to extend through openings in the components may be provided.

The construction set components according to the principles of the present invention provide for safely and rapidly prototyping a user-definable apparatus. In terms of safety, the components be configured with substantially non-sharp corners to substantially eliminate risk of injury to the user or objects. In one embodiment, the corners may be chamfered. Alternatively, the corners may be rounded. In terms of components for rapid prototyping, in addition to or in combination with the construction set components including demarcations, the components may include openings configured to produce substantially no sharp edges in the event of the component being severed at the opening. Further, the components may include slotted bars and angles to allow a user to construct an apparatus in non-regular spacing intervals. Additionally, gussets with various configurations and openings may be included in the construction set to allow for the user to form joints with structural integrity. Fasteners configured to extend through openings in the components may be provided.

To provide for kinetics of the user-definable apparatus, a variable speed, electromagnetic drive assembly may be provided. The variable speed, electromagnetic drive assembly may integrate a motor and an H-bridge circuit. By integrating the H-bridge circuit, with the electromagnetic drive assembly, construction of the user-definable apparatus is both electrical and mechanical simplified. Further, the electromagnetic drive assembly may include protrusion(s) that may be inserted at least part into an opening of a construction set components for alignment purposes.

The construction set according to the principles of the present invention may also include a non-circular drive shaft. The non-circular drive shaft provides for torque transfer between construction set components with substantially the same, non-circular mating openings or sockets. By having a non-circular shape mating opening, a set screw to secure the non-circular drive shaft is eliminated. Further, by providing a drive shaft mating socket, in the electromechanical drive assembly, significant complexity in mechanical torque transfer design is eliminated. Self aligning bearings, in the form of a plate or otherwise, may be provided to allow for smooth rotation of the non-circular drive shafts passing through openings in construction set components.

BRIEF DESCRIPTION OF THE DRAWINGS

A more complete understanding of the methods, apparatus, and systems of the invention may be obtained by reference to the following detailed description when taken in conjunction with the accompanying drawings wherein like reference numerals used throughout the drawings denote the same or similar features.

FIGS. 6A-68 illustrate an exemplary bar-slide angle designed to be alterable to provide for multiple length components for use in constructing a user-definable apparatus, such as that of FIG. 1;

DETAILED DESCRIPTION OF THE DRAWINGS

Figure 1:
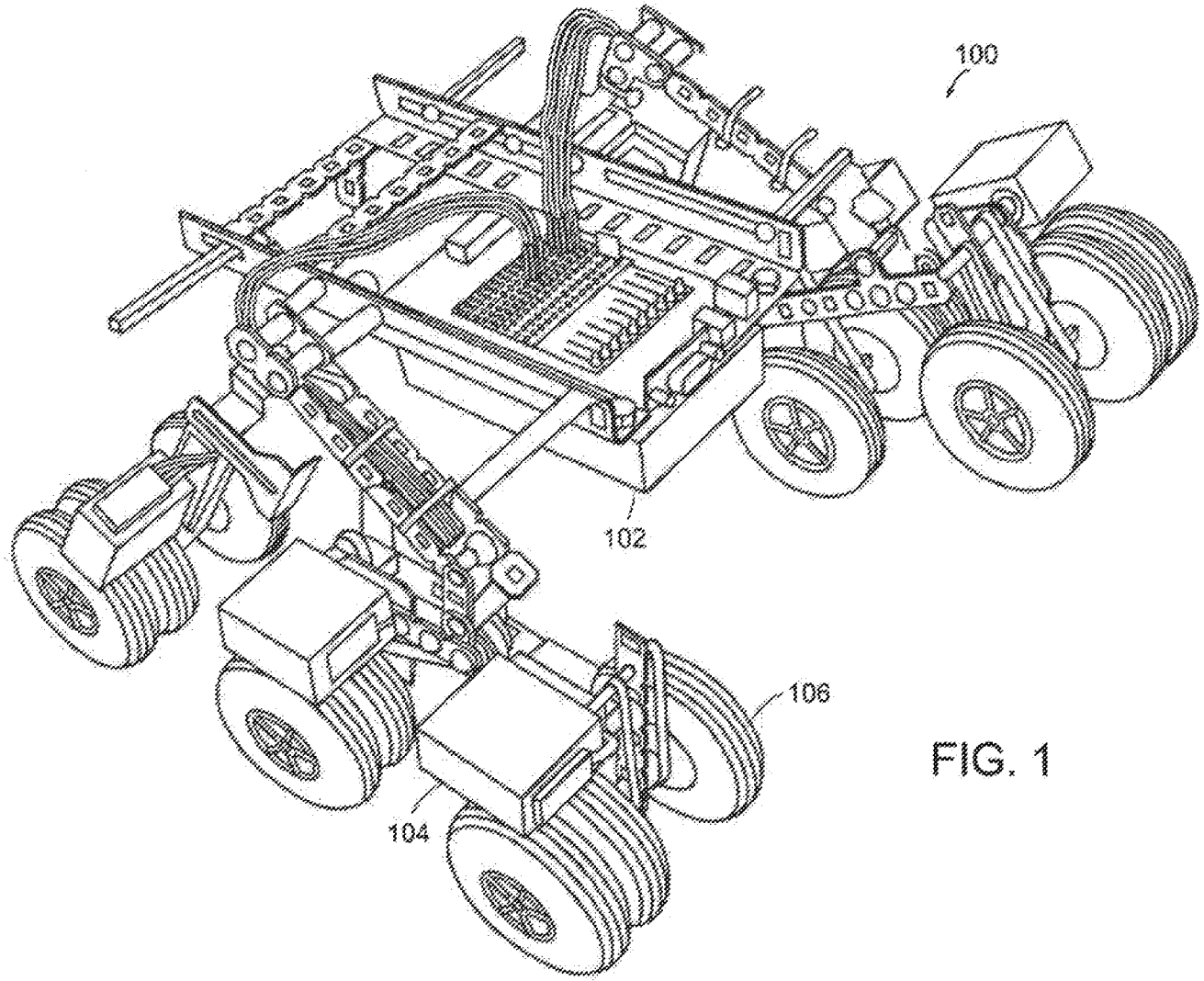
FIG. 1 is an exemplary user-defined apparatus or structure constructed from components of a construction set that are capable of being altered to form a different component.

A construction set includes construction set components ("components") for use in constructing an apparatus. One embodiment of a construction set according to the principles of the present invention provides for at least one construction set component designed to be alterable to enable reconfiguration for use in constructing a user-definable apparatus of structure. A construction set component is a component provided in a construction set for constructing an apparatus.

A user-definable apparatus is one in which the user of the construction set may define a type of apparatus, for example, a robot versus a car versus a statue versus an airplane. By contrast, a non-user definable apparatus is one that a designer and/or manufacturer of a construction set predetermines and provides components intended to build only the non-user definable apparatus. For example, a model kit for constructing an airplane (e.g., B-52 bomber) would not be considered a user-definable apparatus since the only type of apparatus intended to be constructed with the components of that model kit is the B-52 bomber airplane. The designer and/or manufacturer may include optional components, for example, gun turrets, missiles or bombs, and decorative features, such as decals; however, the resulting apparatus is still an airplane. While one apparatus that, can be built with a construction set for constructing a user-definable apparatus may be an airplane, because of versatility of the component(s), many other types of apparatus may be constructed, in another example, a train or slot car set may come with track pieces with which a user may configure different tracks, but the track is a non-user definable apparatus because it remains a track no matter how it is configured. A user-definable apparatus does not preclude one that a designer and/or manufacturer of a construction set has predetermined and provided components to build the apparatus if the components are intended to be used to construct different apparatus of the same or different type. For example, a construction set for constructing a user-definable apparatus may be provided with instructions to build one or more apparatus and the user may define and build different apparatus of the same or different type.

A component designed to be alterable is a component having at least one demarcation, indentation, or other user-identifiable feature that enables the component to be altered or reconfigured into one or more different components. The altering or reconfiguring may include bending, separating, severing, cutting or otherwise changing the permanent or non-permanent form (see, for example, FIGS. 2A-2B) of the component designed to be altered. A component that may be altered (e.g., bent or cut) without having a predefined demarcation or other identifiable indicia or structural identifier for altering the component is not a component designed to be alterable according to the principles of the present, invention.

The principles of the present invention enable building a user-definable apparatus with the component designed to be alterable and other components configured to engage feature(s) of the components designed to be alterable. In one embodiment, the component designed to be alterable, may include openings or holes of different sizes to enable a drive component, such as a non-circular shaft, to engage an opening conforming to the size of the drive component or to rotate without interference within an opening larger than the external profile of the drive component. The construction set may further include electromechanical components, such as an electromechanical drive assembly, that may be configured to move the components. In one embodiment, the electromechanical drive assembly may have a drive port or socket being non-circular in profile and operable to receive and drive or translate motion to a non-circular shaft at least partially conforming to the internal profile of the socket. By using a non-circular shaft, a higher torque may be applied to a mechanical component being rotated by the non-circular shaft than by a circular shaft, which requires use of a set-screw or other locking element. Still yet, other components configured to be coupled to the components designed to be alterable and either engage or support rotation of the non-circular shaft may be provided to further provide flexibility in construction of the user-definable apparatus. The construction set according to the principles of the present invention may be utilised by teaching and/or other organizations in teaching students or participants of an event in real-world design management because the construction set includes components designed to be alterable for use in constructing a user-definable apparatus. In the teachings, the students learn about, but are not limited to, of optimising material usage, managing cost, inventory, design, and manufacturing issues. Problem solving skills are further developed by users of the construction set according to the principles of the present invention.

Mechanical Components

FIG. 1 is an exemplary user-defined apparatus or structure 100 constructed from components of a construction set that are capable of being altered to form a different component. As shown, the user-defined apparatus 100 is electromechanical in that a controller 102 is used to control electromechanical drives or motors 104, which, in turn, drive rotational components, such as wheels 106 that support the mechanical structure configured by components of the construction set that are designed to be alterable. As shown, the user-defined apparatus 100 is kinematic in that the structure incorporates provisions for movement, by internal or external sources, of at least one component of the structure. The user-defined apparatus 100 may be of a scale suitable for operation on the top of a table, or alternatively, smaller or larger. Because the components are designed to be alterable, the user-defined apparatus 100 produced to perform a function by a user of the construction set is capable of being configured completely different using the same components designed to be alterable provided in the construction set according to the principles of the present invention.

Figure 2A:
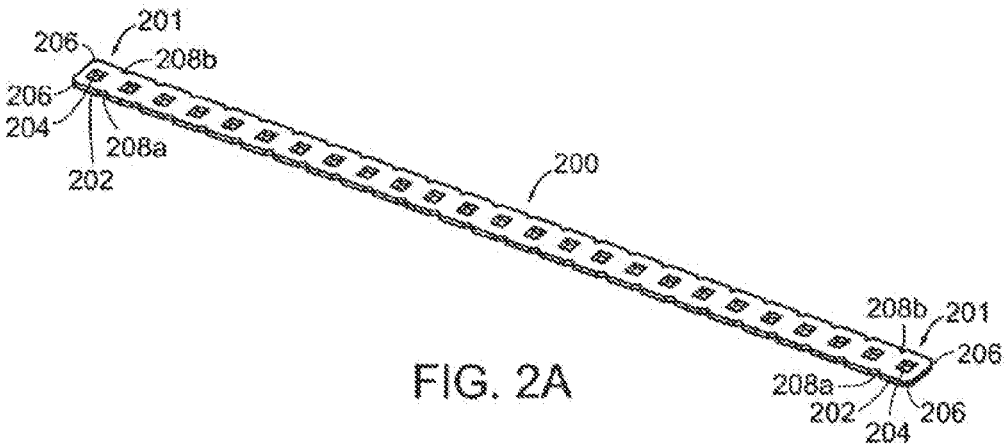
FIGS. 2A-2E are exemplary representations of a component configured as a fear designed to be alterable via indentations defining borders of adjacent segments for use in constructing a user-defined apparatus, such as that of FIG. 1.

FIG. 2A illustrates an exemplary bar 200 that is designed to be alterable for use in constructing the user-defined apparatus 100. FIG. 2A is a front, top perspective view showing the bar's 200 left edge. The appearance of the bottom surface, rear edge and right edge may be substantially the same. The bar 200 has a predetermined length that is typically longer than a length used in constructing a user-definable structure. Because the bar 200 is designed to be alterable (e.g., cut, bent, or otherwise reconfigured), the bar 200 may be shortened in length, bent, or otherwise altered in dimension according to the desires of the user of the construction set.

The bar 200 includes multiple segments 201 extending along the length of the bar 200. The segments 201 of the bar 200 are shown to be substantially identical. However, it should be understood that the segments 201 may have different shapes and/or configurations. The segment 201 includes an outside edge 202 and an opening 204. The outside edges 202 are designed to substantially prevent injury, such as scraping or cutting, to a user by providing for dulled corners and obtuse angles at the corners of the bar 200. Alternatively, the corners may be curved or have another shape designed to substantially prevent injury to a user. As shown, the corners of the bar 200 are chamfered 206 to avoid having a sharp corner. A sharp corner is one which is likely to scratch or cut skin or other material. A sharp corner typically has an acute angle or burr as understood in the art.

Figure 2B:
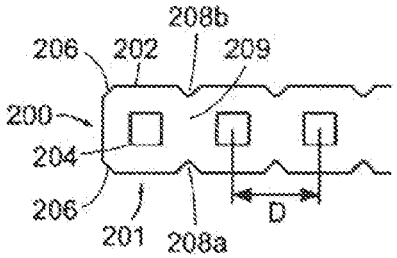

The opening 204 in the segment 201, as shown, is substantially shaped as a square. The opening 204, however, may have another polygonal shape, such as a triangle, hexagon, rectangle, or circular, curved, elliptical, irregular, or otherwise to receive coupling or fastening elements. As will be discussed in more detail below, the openings 204 are adapted to receive a drive shaft (such as shaft 1302 of FIG. 13) and allow the drive shaft to rotate freely therein, in one embodiment, the openings 204 are spaced at regular intervals D (FIG. 2B). The regular intervals may be one-half inch spacing between the center of the openings 204.

Demarcations may be provided on the bar 200 that define the border between adjacent segments 201. The demarcation may be represented fey one or more indentations 208*a*-208*b* (collectively 208), grooves, scores, perforations, or other features known in the art to define a border between adjacent segments 201. At least one demarcation may reduce resistance to bending of the bar 200 along or extending substantially between the demarcation(s). Additionally, at least one demarcation may substantially prevent a sharp corner from forming in the event that the bar 200 is separated, severed or bent at the demarcation.

FIG. 2B provides an exemplary portion of the bar 200 magnifying the features thereof. The indentations 208 are shown as being substantially opposed along the outside edge 202 of the bar 200. The indentations 208 being substantially opposed define a border between adjacent segments so that the bar 200 may be altered along the plane of the opposed indentations 208. The indentations 208 may alternatively and/or additionally be disposed on the top and bottom surfaces 209 of the bar 200. In one embodiment, the indentations 208 may be scores on the top and bottom surfaces of the bar 200.

Figure 2E:
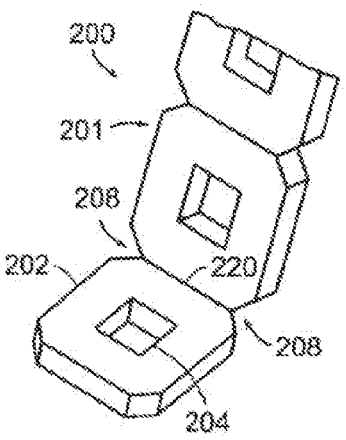
Figure 2C:
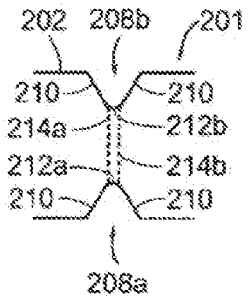

FIG. 2C depicts an enlarged section of the bar 200 having the substantially opposed indentations 208. Demarcations 214*a* and 214*b* (collectively 214), which extend between the indentations 208, may be utilised to facilitate altering the bar 200 in relation thereto. The demarcations 214 may be a score, perforation, line, groove, print, or other insignia that facilitates altering the component. It should be understood that the demarcations 214 may be associated with other demarcations (e.g., indentations 208) or be independent of other demarcations. The indentations 208 include diagonal edges 210 substantially in a V-shape. Further, radius portions 212*a* and 212*b* (collectively 212) disposed between the diagonal edges 210 for each of the indentations 208*a* and 208*b*, respectively, are included. The radius portions 212 have approximately the same or a slightly larger diameter than a width of a cutting tool anticipated to be used to sever the bar 200.

Normally, when a piece of material is severed, for example with tin snips or shears, edge portions of the material tend to deform outward from the plane of the edge. The material that deforms outward forms a sharp corner, and in many cases, forms burrs that extend outward from the edge surfaces of the material. The shape of the indentations 208 reduces the amount of material available to extrude outside the existing shape of the bar 200, thereby minimizing the formation of burrs when the bar 200 is severed. Further, the indentations form chamfered corners when the bar 200 is severed, thereby eliminating a sharp corner that would form without the indentations 208. As a result when segments 201 are severed, the resulting pieces have substantially no burrs or sharp corners.

Figure 2D:
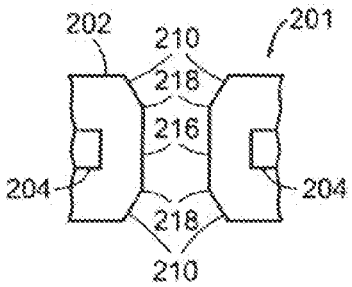

FIG. 2D illustrates a resulting separation of two adjacent segments 201 substantially between the indentations 208. The resulting bar segments include new edges 216 formed along the line of separation between the indentations 208 having separation corners 218 with substantially no sharp artifacts. It should be understood that the indentations 208 with the radius portion 212 may be configured with other shapes, such as curves, that result in substantially no sharp corners being formed and conform to the principals of the present invention.

FIG. 2E illustrates an exemplary bar 200 having been altered to form a bend between the indentations 208 to result in a different component (i.e., a component that has been altered in size, shape, or other dimensions). A border 220 between the segments 201 shows that the bar 200 may be reconfigured or plastically deformed substantially without breaking due to, at least in part, the material of the bar 200. In one embodiment, the material of the bar 200 is metal that is plastically deformable without substantially breaking. The metal may be cold rolled steel, which provides good altering properties and is cost effective for producing components to be utilized for the construction set. Alternatively, the material of the bar 200 may be formed of a plastic that allows for altering or bending without substantially breaking and capable of maintaining a reconfigured shape.

Figure 3A:
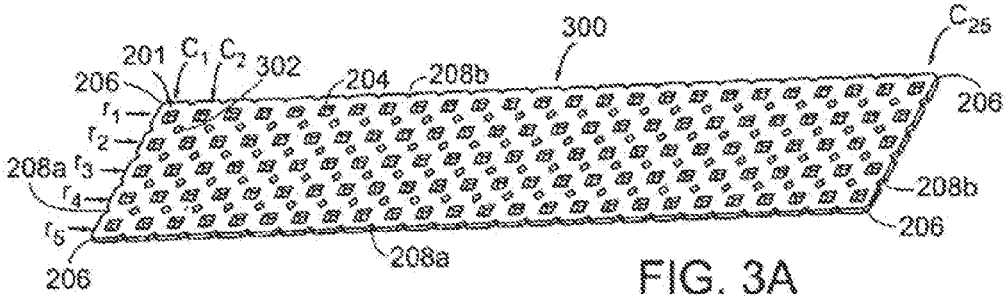
FIGS. 3A-3E illustrate exemplary views of a component configured as a plate designed to be alterable via indentations and openings defining borders of segments for use in constructing a user-defined apparatus, such as that of FIG. 1.

FIG. 3A shows an exemplary plate 300 designed to be alterable for use in constructing the user-definable apparatus of FIG. 1. FIG. 3A is a front, top perspective view showing the plate's 300 left edge. The appearance of the bottom surface, rear edge and right edge may be substantially the same. The plate 300 includes segments arranged in rows $r_1$-$r_5$ and columns $c_1$-$c_{25}$. Similar to the segments 201 of the bar 200, openings 204 are disposed therein. Each opening 204 is shown to be shaped as a square, but may be any other shape operable to be coupled to other components and/or fasteners of the construction set. The openings 204 may be shaped or oriented differently (e.g., square and hexagonal) on the plate 300. As above/the openings 204 are adapted to receive a drive shaft (such as shaft 1302 of FIG. 2) and allow the drive shaft to rotate freely therein and also adapted to receive a fastener for joining the plate 300 to other construction set components. In one embodiment, the openings 204 are spaced at regular intervals. While the segments 201 are shown to be substantially identical along the plate 300, it should be understood that the segments may be configured to be different along certain areas or regions and have a variety of orientations and/or configurations. Indentations 208 are substantially opposed along a plane between both the rows and columns to define borders between a grid of segments thereof, respectively. Additionally, to substantially prevent injury to users or other materials, chamfers 206 are disposed on the corners of the plate 300.

Disposed substantially between a set of substantially opposed indentations 208 are openings 302 being substantially diamond-shaped. The openings 302 are substantially squares that are aligned approximately 45 degrees in relation to the openings 204 disposed in the segments 201. Openings 302 function similar to indentations 208, in that they are configured to reduce the amount of material available for extrusion when severed between openings 302, for example with clippers, thereby substantially preventing the formation of burrs. Furthermore, smaller pieces severed from the 300 will resultantly have chamfered corners. In addition to being configured to substantially prevent the formation of burrs and sharp corners, the openings 302 can be sized to receive a component, such as the drive shaft 1302 of FIG. 13, and prevent rotation of the component relative to the opening 302. It is important to note that the component engaged by the diamond-shaped opening 302 may pass and rotate freely through the segment opening 204.

Figure 3B:
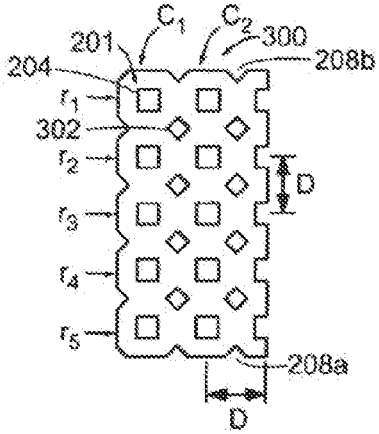
Figure 3C:
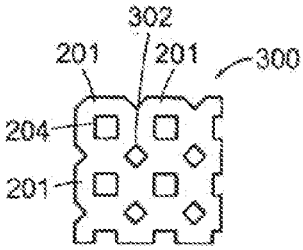
Figure 3D:
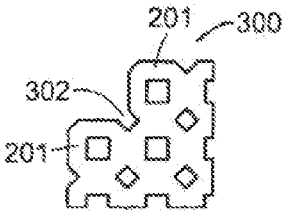
Figure 3E:
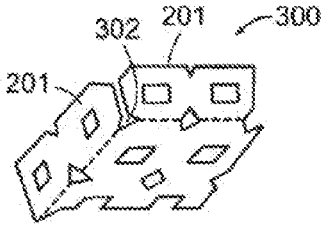

The opening 302 may be substantially regularly spaced between the segments 201 of the plate 300. Alternatively, the openings 302 may be spaced in another configuration based on different desires of the designer to enable a user to separate and/or alter the plates 300. It should be further understood that the openings 302 may have a shape other than a diamond, such as a hexagonal, octagonal, or other shape that substantially prevents sharp corners front being formed upon separation of adjacent segments 201. Accordingly, the opening 302 being diamond or other polygonal shape includes a radius portion, such as the radius portion 212, at the intersection of the internal edges so as to substantially prevent the formation of sharp corners. The openings 302 reduce bending strength along the axis of the openings 302. Furthermore, the openings 302 provide an additional benefit when bending two or more adjacent edges of the plate 300. As seen in FIGS. 3C-3E, when a segment 201 is removed at a corner of the plate 200 and the edge segments 201 are bent out of the plane of the plate 200, the openings 302 provide a pre-made bend relief as commonly used in the art of sheet metal fabrication. A bend relief involves removing a small amount of metal at the point at which two bend lines meet. Without a bend relief, the material at the two bends would contact and deform at the point at which they meet. The bend relief is created by simply removing the material (e.g., metal) at which the bends collide.

Because the plate 300 includes demarcations, such the indentations 208 and openings 302, it may be said that the plate is designed to be alterable by the user to form a different component of the construction set. The different component may be any component that has a different dimension and/or shape than that of the plate 300. The plate 300 may be composed of a material to enable reconfiguration. In one embodiment, the material of the plate 300 may be metal, such as cold roll steel, that allows for plastically bending without breaking. The material may further provide for cutting and/or separation by a method other than cutting. In another embodiment, the material of the plate 300 may be a plastic material that may be bent and retain the bent shape. FIG. 3B shows a detail view of the plate 300 depicting the indentations 208 and openings 302 that enable alteration of the plate 300 and prevent sharp corners from being formed. Accordingly, the openings 302 being disposed to define borders between adjacent segments 201 may operate as demarcations irrespective of the indentations 208.

Figure 4A:
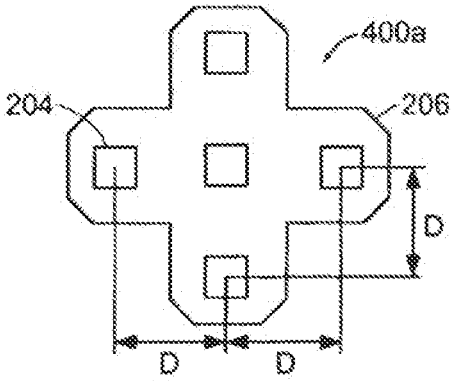
FIGS. 4A and 4B illustrate exemplary components configured as "plus" gussets for use in constructing a user-definable apparatus, such as that of FIG. 1.

FIG. 4A is an exemplary component shaped as a plus gusset 400*a* for use in constructing a user-defined apparatus, such as that of FIG. 1. FIG. 4A is a top view of the plus gusset 400*a*. The appearance of the back side is substantially similar. As shown, the plus gusset 400*a* is formed of a single piece of material and includes rectangular openings 204 being substantially square and having a regular spacing. In one embodiment, the spacing substantially matches the spacing of the openings 204 of the bar 200 and plate 300. It should be understood, however, that the openings 204 may have spacings other than regular and shapes other than squares. The corners of the plus gusset 400*a* have chamfers 206 to avoid having sharp corners to substantially prevent injury or damage to users or materials that come in contact with the plus gusset 400*a*.

Figure 4B:
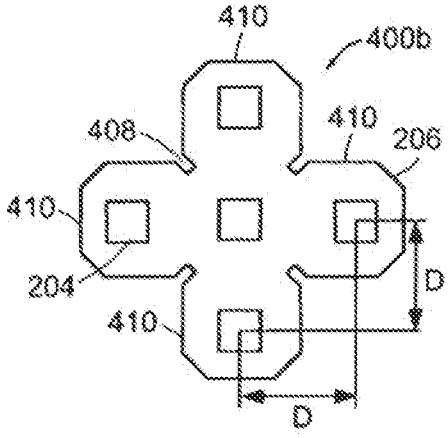

FIG. 4B is an exemplary plus gusset 400*b* designed to be altered and is thereby provided with demarcations 408. FIG. 4B is a front view. The appearance of the bottom surface may be substantially the same. In the exemplary embodiment shown, the demarcations 408 may be indentations in a rectangular C-shape that is similar to the shape left when diamond shaped openings 302 of plate 300 (FIGS. 3A-3E) are cut. The demarcations define segments 410 of the plus gusset 400*b* and facilitate alteration of the plus gusset 400*b* to make other construction set components. For example, the plus gusset 400*b* may be formed into a T-shape by severing one segment 410 or into an L-shape by severing two adjacent segments 410. Furthermore, the plus gusset 400*b* may be bent into different shapes. Either plus gusset 400*a* or 400*b* may be formed of metal that is plastically deformable without substantially breaking.

The plus gusset 400*a* or 400*b* may be utilized to facilitate coupling of components of the construction set, including those joined at right angles. For example, the plus gusset 400*a* or 400*b* may be utilised at the juncture of two bars 200 to increase the rigidity of the connection and hold the bars 200 in fixed relation in forming a user-defined structure, such as that of FIG. 1. The plus shape adds structural strength and versatility to a structure built by a designer. It should be understood, however, that other shaped gussets having openings 204 may be included in the construction set for constructing user-definable structures according to the principles of the present invention.

Figure 5:
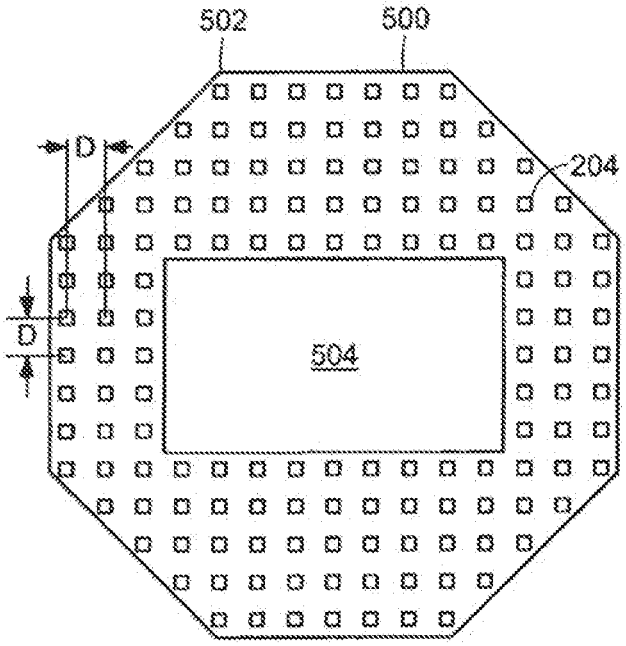
FIG. 5 illustrates an exemplary component configured as a base plate for use in construction a user-definable apparatus, such as that of FIG. 1.

FIG. 5 is an exemplary base plate 500 that is not designed to be alterable for use in construction a user-definable apparatus, such as that of FIG. 1. FIG. 5 is a front view. The appearance of the bottom surface may be substantially the same. Although the base plate 500 is not designed to be alterable, the base plate 500 includes obtuse angles for corners 502 so as to have no sharp corners. The base plate 500 is octagonal-shaped and may be used for a structural support on which a user-definable structure may be constructed. It should be understood that the base plate 500 may have other shapes to provide structural support for construction of a user-definable structure.

The base plate 500 includes rows and columns of openings 204 that may be spaced in accordance with the spacing of the openings 204 of the bar 200 and plate 300 so as to enable coupling therebetween. Rectangular orifice 504 may be disposed substantially in the center of the base plate 500 to enable electronics or other mechanical components to be accessed or extend therethrough.

Figure 6A:
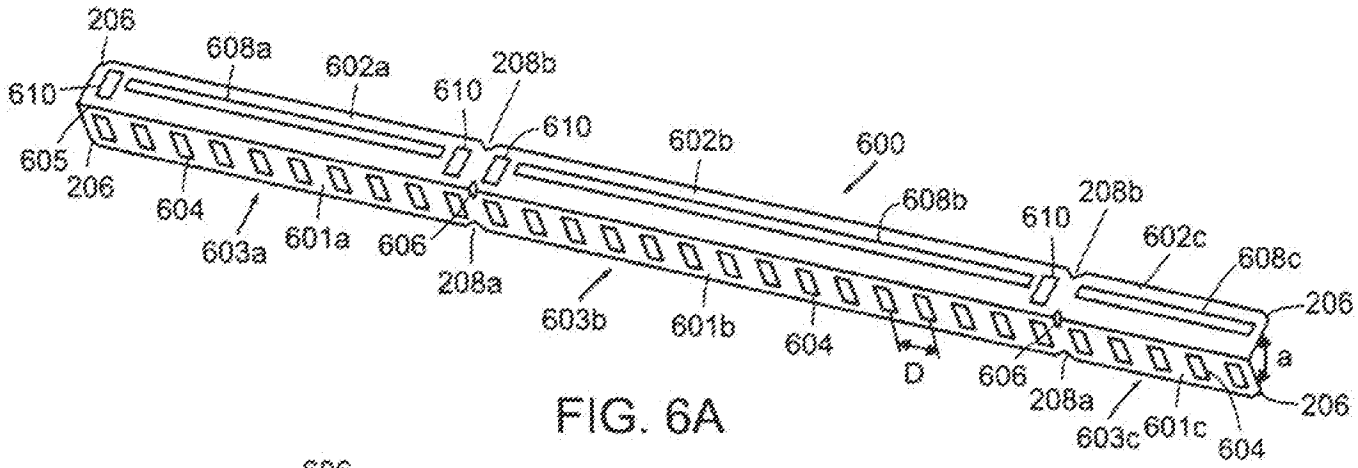

FIG. 6A illustrates an exemplary bar-slide angle 600 designed to be alterable to provide for multiple length components for use in constructing a user-definable apparatus, such as that of FIG. 1. The bar-slide angle 600 includes two substantially planar portions, a bar portion 601*a*-601*c* (collectively 603) and a slide portion 602*a*-602*c* (collectively 602). Each bar and slide portion (e.g., 601*a* and 602*a*) are formed as segments 603*a*-603*c* having demarcations in the form of indentations 208 being substantially opposed/although not in 180 degree relation.

The bar portion 601 includes openings 604 disposed thereon. The openings 604 are substantially rectangular in shape and have a spacing conforming to that of the spacing of the openings on the bar 200 and/or plate 300. It should be understood that the openings 604 may be other than rectangular, but that the rectangular shape, as with the other rectangularly shaped openings in the construction set, enables adjustably positioning the bar-slide angle 600 in relation to another component of the construction set, such as the base plate 500, at positions that depart from the grid pattern of the openings 204 when coupling the bar-slide angle 600 to the other component. The openings 604, as shown, are oriented with a longer dimension substantially perpendicular to the length of the bar-slide angle 600, but can be oriented in other directions. As with openings 204, the openings 604 can be configured to receive fasteners and a drive shaft (such as the drive shaft 1302 of FIG. 13) and allow the drive shaft to rotate therein. One or more additional substantially rectangular slide openings 608*a*-608*c* (collectively 608) can be provided in the slide portion 602 and oriented substantially perpendicular to the orientation of the openings 604, that is with a longer dimension substantially parallel to the length of the bar-slide angle 600. One or more additional side openings 610 can be disposed adjacent a given slide opening in the slide portion 602 and oriented in the same or similar manner to openings 604, that is with a longer dimension perpendicular to the length of the bar-slide angle 600. As with the openings 604, the slide openings 608, and side openings 610 can be configured to receive fasteners and a drive shaft (such as drive shaft 1302 of FIG. 13) and allow the drive shaft to rotate therein. The side openings 610 may be rectangular or otherwise.

The bar-slide angle 600 can be formed of a single piece of material and has an angle extending between the bar portion 601 and slide portion 602 along a common edge 605. The angle is shown to be 90 degrees, but could be any other angle. The bar-slide angle 600 may be formed of metal that is plastically deformable without substantially breaking.

The bar-slide angle 600 is composed of the three segments 603*a*-603*c* having different lengths. The bar-slide angle segment 603*a* includes ten openings 604 in the bar portion 601*a*; the bar-slide angle segment 603*b* includes fifteen openings 604 in the bar portion 601*b*; and the bar-slide angle segment 603*c* includes five openings 604 in the bar portion 601*c*. The number of openings 604 corresponds to the relative length of the segments 603. Accordingly, slide openings 608*a*-608*c* disposed in the respective slide portions 602*a*-602*c* of the bar portions 601*a*-601*c* also extend different lengths. Openings 610 disposed on the slide portions 602*a* and 602*b* provide locking ability for the longer bar-slide segments 603*a* and 603*b* in construction. By arranging the three segments as shown, it is possible to produce bar-slide angles 600 having bar sections 601 with five, ten, fifteen, twenty, twenty-five and thirty openings 604 by cutting or separating the bar-slide angle 600 in relation to the indentations 208. For example, to produce a bar-slide angle 600 with twenty openings 604 (and the corresponding length thereof), one would sever the portion of the bar-slide angle 600 having fen openings thereby retaining the portions having five openings 604 and fifteen openings 604 (i.e., 5+15=20). To produce a bar-slide angle 600 with twenty five openings 604, one would sever the portion of the bar slide angle 600 having five openings 604. Clearly, to produce a bar-slide angle 600 with five, ten or fifteen openings 604, one need only sever the segment containing the correct number of openings 604. It should be noted that the principle of segmenting a component, such as that of the bar-slide angle 600, may be applied to other components of the construction set.

Figure 6B:
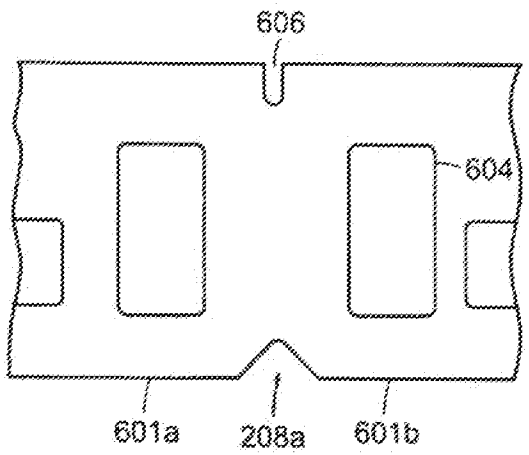

FIG. 6B provides a detail view of the Intersection between bar portion 601*a* and 601*b*. As shown, indentation 208*a* is disposed substantially in opposed relation to indentation 806. The indentation 606, can be shaped different from the indentation 208*a*, but still operable to provide for cutting along the intersection between the bar portion 601*a* and 601*b*. Accordingly, the opening 608 is disposed on the bend (common edge 605) to enable the user to separate the bar-slide angle segments 603 with relative ease. The separation may be performed utilizing a tool that cuts between the indentation 208*a* and opening 606.

Figure 7:
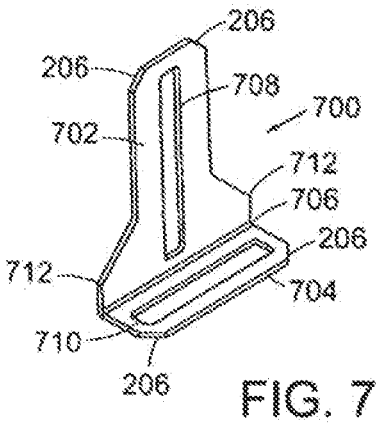
FIG. 7 illustrates an exemplary component configured as an angle gusset having slot openings for use in constructing a user-definable apparatus, such as that FIG. 1.

FIG. 7 is an exemplary angle gusset 700 having slot openings for use in constructing a user-definable apparatus, such as that of FIG. 1. The angle gusset 700 includes a first substantially planar portion 702 coupled to a second substantially planar portion 704 along an edge 706. The angle gusset 700 can be formed from a single piece of material bent along the edge 706 to form a 90 degree angle between the first and second portions 702 and 704. To provide strength, in one embodiment, the angle gusset is formed of metal, such as cold rolled steel or other material that is plastically deformable without substantially breaking As shown, a first slot opening 708 is disposed along the first portion 702 and a second slot opening 710 is disposed along the second portion 704. The slot openings 708 and 710 are oriented substantially perpendicular in relation to one another. The first slot opening 708 is substantially centered about the midpoint of the second slot opening 710. The respective slot openings 708 and 710 are sized to allow coupling to other components of the construction set via fasteners, and can also, one or both, be configured to receive a drive shaft, such as drive shaft 1302 of FIG. 13, and allow the drive shaft to rotate freely therein. Although shown in a bent configuration, the angle gusset 700 may be flat, such that both the first and second portions 702 and 704 are in the same plane. Alternatively, the angle gusset 700 may have an angle between the first and second portions 702 and 704 other than 90 degrees. The slot openings 708 and 710 are aligned to allow coupling of other components on non-half pitched spacings to allow a user to design user-definable structures in a more flexible manner.

In accordance with the principles of the present invention, the angle gusset 700 includes chamfers 206 to substantially eliminate sharp corners. Additionally, the first portion 702 utilizes obtuse angle corners 712 to prevent having a sharp corner, thereby substantially preventing risk of injury for a user. It should be understood that curves or other non-sharp corners may be utilized rather than having angled corners via the chamfers 206 or otherwise.

Figure 8:
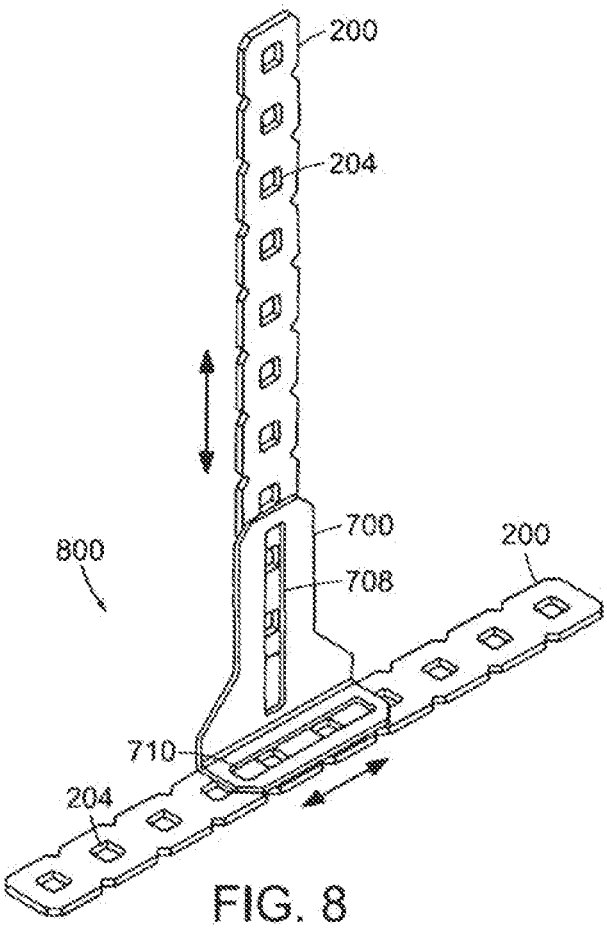
FIG. 8 illustrates an exemplary configuration of the angle gusset of FIG. 7 being aligned with the bar of FIG. 2A.
Figure 9A:
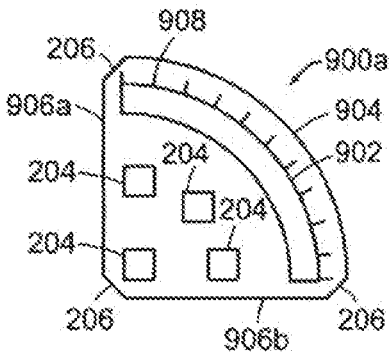
FIGS. 9A and 9B illustrate exemplary components configured as an angle pivots having an arcuate slot opening for use in constructing a user-definable apparatus, such as that of FIG. 1.
Figure 9B:
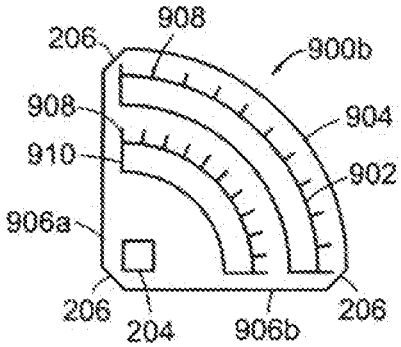

FIG. 8 is an exemplary configuration 800 of the angle gusset 700 of FIG. 7 being aligned with the bar 200 of FIG. 2A. As shown, the angle gusset 700 may be aligned with the openings 204 of the bars 200. Because the slot opening 710 does not require regular or non-regular spacing, orientation of the perpendicular bar 200 coupled to the slot opening 708 of the angle gusset 700 may be aligned on a variable-pitch spacing with respect to the bar 200 coupled to the slot opening 710 of the angle gusset 200. Accordingly, the angle gusset 700 may be coupled to other components (e.g., plate 300 and base plate 500 for constructing a user-definable structure). To engage the angle gusset 700 with other components, fasteners may be utilized to secure or allow sliding of the components with respect to the angle gusset 700. The angle gusset 700 can be formed from metal or other material that is plastically deformable without substantially breaking FIG. 9A is an exemplary angle pivot plate 900*a* having an arcuate slot opening 902 for use in constructing a user-definable apparatus, such as that of FIG. 1. FIG. 9A is a front view. The appearance of the bottom surface may be substantially the same. The angle pivot plate 900*a*, as shown has one arcuate slot opening 902 and is substantially planar. In one embodiment, the angle pivot plate 900*a* and 900*b* may be formed from a material that is plastically deformable without substantially breaking. The arcuate slot opening 902 is disposed substantially about a center point and can have a substantially constant radius. Additional arcuate slot openings may be proved adjacent the arcuate slot opening 902. See, for example, the exemplary angle pivot plate 900*b* of FIG. 9B, which, as shown, has two arcuate slot openings 902 and 910. FIG. 9B is a front view. The appearance of the bottom surface may be substantially the same. Providing two arcuate slot openings 902 allows mounting an electromechanical drive assembly (such as electromechanical drive assembly 2402 of FIG. 24A) to one slot with the drive shaft extending through the adjacent slot to thereby allow angular adjustably of the electromechanical drive assembly relative to the angle pivot plate 900*b*. Such a combination is well suited for use as a compact drive line tensioner.

An arcuate edge 904 is disposed on the opposite side of the center point of the arcuate slot opening 902. Further, the angle pivot plate 900 may be configured to have a first edge 906*a* and a second edge 906*b* that have a substantially perpendicular orientation therebetween. It should be understood, however, that other angles may be provided for the angle pivot plate 900. The arcuate slot opening 902 may have indicia 908 that indicate angle about the arc of the slot opening 902. Further, openings 204 being sized and shaped substantially similar to the openings 204 of other components may be disposed between the arcuate slot opening 902 and the center point thereof to enable the angle pivot plate to be coupled to another component of the construction set for constructing a user-definable apparatus. As shown, the angle pivot plate 900 has an opening 204 at the center point of the arcuate slot opening 902, and three openings 204 substantially equidistant between the center point and the arcuate slot opening 902. The openings 204 can be substantially non-circular, and as shown are substantially square with an edge aligned with an edge of the angle pivot plate 900. As with other components of the construction set, the angle pivot plate 900 can be made of out metal that is plastically deformable without substantially breaking.

Figure 10:
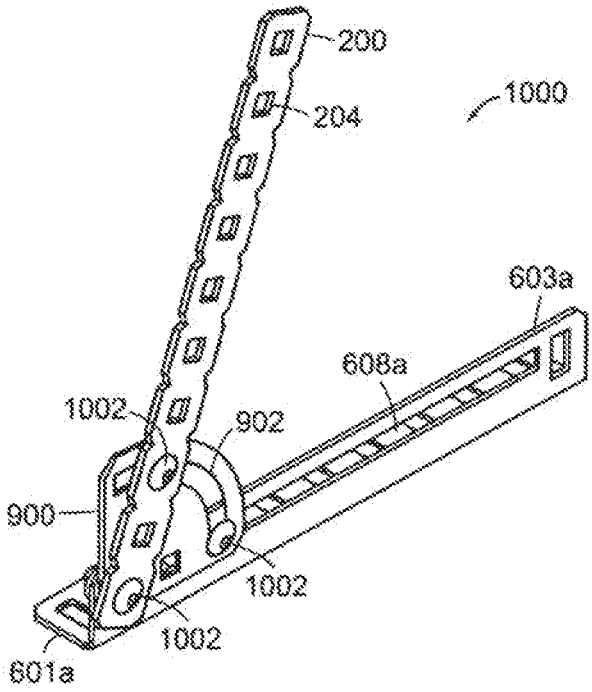
FIG. 10 illustrates an exemplary configuration of the angle pivot of FIG. 9 being coupled with a portion of the bar-slide angle of FIG. 6A and the bar of FIG. 2A.

FIG. 10 is an exemplary configuration 1000 of the angle pivot plate 900 of FIG. 9 being coupled with the bar-slide angle 603*a* of FIG. 6A and the bar 200 of FIG. 2A. As shown, the bar 200 is coupled to an opening 204 at or near the center point of the arcuate slot opening 902. The opening 204 may be spaced consistent with the spacings of the openings 204 of the bar 200. In one embodiment, the arcuate slot, opening 902 is disposed at multiple (e.g., double) spacings from the opening 204 at the center point of the arcuate slot opening 902 to enable a fastener 1002 extending through the opening 204 of the bar 200 and extending through the arcuate slot opening 902 to travel through the arcuate slot opening to allow the bar 200 to pivot relative to the angle pivot plate 900, accordingly.

The angle pivot plate 900 is further coupled to the ten-opening bar-slide angle segment 603*a* of the bar-slide angle 800. By coupling the slide opening 603*a* of the bar-slide angle segment 603*a*, the angle pivot plate 900 may be positioned at any location along the slide opening 608*a* to provide flexibility in constructing the user-definable structure. The position of the bar 200 relative to the bar-slide angle segment 603*a* is infinitely adjustable within the range of the arcuate slot opening 902. The fastener 1002 is shown to be a bolt having a lock nut (not shown) operable to be tightened via a hex driver. It should be understood that any other fastener operable to couple the bar 200 to the angle pivot plate 900 via the openings 604 on the bar portion 601*a* or opening 610 on the slide portion 602*a* of the bar-slide angle segment 603*a*.

Figure 11:
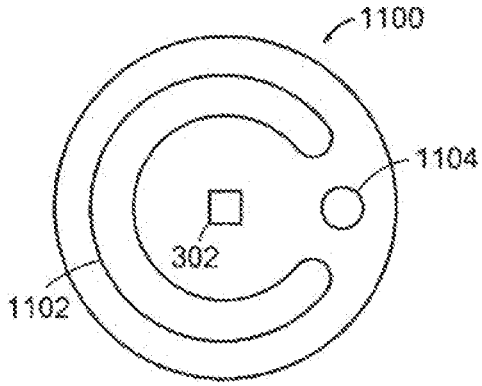
FIG. 11 illustrates an exemplary component configured as a switch disk having an arcuate slot, opening for use in constructing a user-definable apparatus, such as that of FIG. 1.

FIG. 11 is an exemplary switch disk 1100 having an arcuate slot opening 1102 for use in constructing a user-definable apparatus 100, such as that of FIG. 1. FIG. 11 is a front view. The appearance of the bottom surface may be substantially the same. An opening 302 is disposed substantially in the center of the switch disk 1100. In one embodiment, the opening 204 is substantially square having approximately the same size as the openings 204 of the bar 200 or other component of the construction set. The slot opening 1102 may be substantially arc shaped and disposed radially about the opening 204. The slot, opening 1102 can be configured to receive fasteners and a drive shaft, such as drive shaft 1302 of FIG. 13) and allow the drive shaft to rotate freely therein. In one embodiment, the opening 302 can be a shaft engaging opening having an inner profile substantially the same size and shape as that of the outer profile of a shaft (see, for example, FIG. 13) for fixedly engaging the shaft to rotate the switch disk 1100. Alternatively, the opening 302 may be sized substantially the same as the opening 204 to allow a shaft to rotate therein and to receive a fastener for attaching the switch disk 1100 to another component of the construction set. Another opening 1104 may be disposed between the ends of the slot opening 1102 and the disposed at substantially the same radius from the center of the switch disk 1100 as the slot opening 1102 to receive fasteners for coupling the switch disk 1100 to other mechanical components of the construction set. The opening 1104 may be circular or have another shape to receive a fastener.

Figure 12:
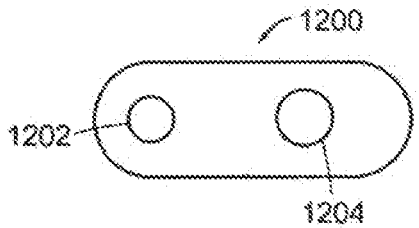
FIG. 12 illustrates an exemplary component configured as a trigger for use with the switch disk of FIG. 11.

FIG. 12 is an exemplary switch trigger 1200 for use with the switch disk 1100 of FIG. 11. FIG. 12 is a front view. The appearance of the bottom surface may be substantially the same. The switch trigger 1200 is a component that includes two openings, a first opening 1202 at one end and a second opening 1204 positioned at a second end of the switch trigger 1200. The second opening 1204 is positioned at a greater distance nom the second end than the first opening 1202 in relation to the first end. The openings 1202 and 1204 are spaced to be aligned with the opening 302 centrally positioned in the switch disk 1100 and the arcuate slot 1102 of the switch disk 1100. The first opening 1202 on the switch trigger 1200 is adapted to be axially aligned with the opening 302 of the switch disk 1100 and allow free rotation of a shaft extending therethrough. The second opening 1204 is adapted to receive a fastener that may be positioned through the arcuate slot 1102 of the switch disk 1100.

Figure 13:
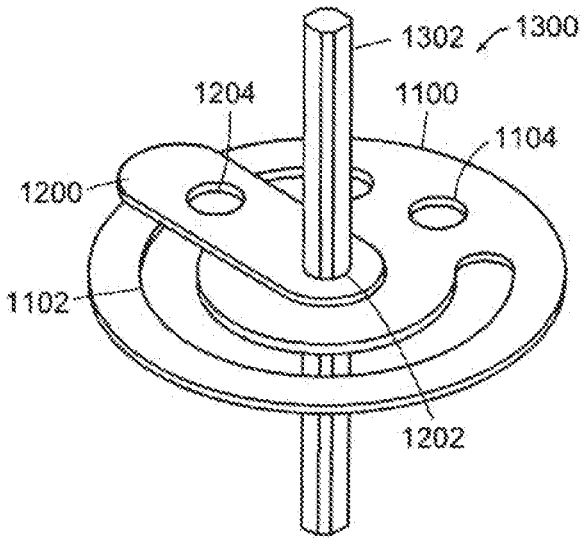
FIG. 13 illustrates an exemplary configuration of the trigger of FIG. 12 in association with the switch disk of FIG. 11 along with a non-circular shaft for rotating the trigger with respect to the switch disk.

FIG. 13 is an exemplary configuration 1300 of the switch trigger 1200 of FIG. 12 in association with the switch disk 1100 of FIG. 11 along with a shaft 1302 being non-circular for rotating the switch disk 1100 with respect to the switch trigger 1200. The switch disk 1100 may be rotated by the drive shaft 1302 by interfacing with the opening 302 (see, FIG. 11) to substantially operate as a fixed or variable earn, and may be used as a mechanical switch or in conjunction with an electrical switch and the like. By rotating the drive shaft 1302, the switch disk 1100 rotates accordingly while the switch trigger 1200 may be set at a predetermined angle to operate as a mechanical switch as understood in the art. It should be understood that the coupling of the switch trigger 1200 to the switch disk 1100 may allow for a multitude of angular rotations of the switch disk 1100, and may provide for angular measurements through the inclusion of indicia (not shown) on the switch disk 1100 or via electronic calibration.

Figure 14B:
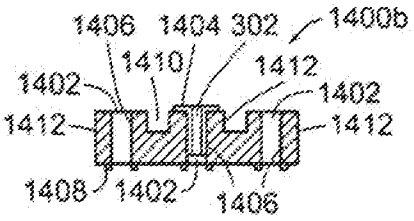
FIGS. 14A-C illustrate exemplary components configured as locking bars operable to be used in constructing a user-definable apparatus, such as that of FIG. 1.
Figure 14C:
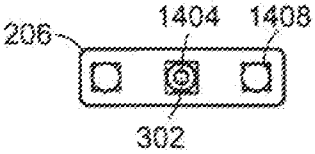
Figure 14A:
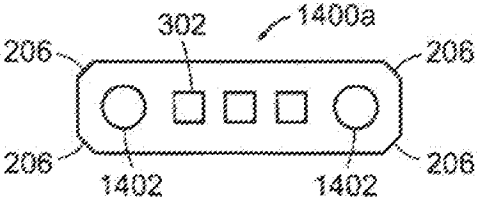

FIGS. 14A-14C are exemplary lock plates 1400*a* and 1400*b* operable to be used in constructing a user-definable apparatus 100, such as that of FIG. 1. As many of the components described above include openings 204 that receive a drive shaft (such as drive shaft 1302 of FIG. 13) and allow the drive shaft to rotate within the opening, a lock plate 1400*a* or 1400*b* can be provided for attachment to the components to lock the drive shaft in relation to the component. Accordingly, the lock plate 1400*a* includes at least one shaft engaging opening 302 that is sized and shaped to engage a non-circular shaft 1302. FIG. 14A is a front view. The appearance of the bottom surface may be substantially the same. As shown, the shaft engaging opening 302 is substantially square to engage a substantially square shaft 1302. Alternatively, the shaft engaging opening 302 may have any other non-circular shape to engage a shaft that is non-circular and prevent rotation of the shaft relative to the opening 392 (e.g., example a flat surface that engages a fiat surface of the shaft). An opening 1402 may be disposed at each end of the lock plate 1400*a*. The opening 1402 may configured to enable a fastener to engage the lock plate 1400*a* and another component having an opening (e.g., bar 200 with openings 204).

As shown in FIG. 14B, lock plate 1400*b* has an insert 1404 that is insertable into one or more than one of the openings 1402 and has a shaft engaging opening 302 therein. The exterior surface of the insert 1404 engages the interior surface of the openings 1402 to prevent rotation of the insert 1404 in the opening 1402. The engagement mechanism 1406 may be splines, key and keyway, friction fit, or otherwise. If splines or a key and keyway are used, such can be configured to enable the insert 1404 to be inserted with the shaft engaging opening 302 oriented in varying relation to the longitudinal axis of the lock plate 400*b*. For example, the engagement mechanism 406 may allow the shaft engaging opening 302 to be changeably positioned to substantially align a flat surface of the drive shaft substantially parallel to the longitudinal axis of the lock plate 1400*b* or at an angle to the longitudinal axis of the lock plate 1400*b*. One common spline configuration would allow the shaft engaging opening 302 to be rotated in 12 degree increments relative to the lock plate 1400*b*.

Lock plate 1400*b* is also provided with protrusions 1408 adapted to engage an interior of an opening (such as opening 204 of FIG. 15A) and substantially center the shaft engaging opening 302 over the opening or another opening. The protrusions 1408 can also align the lock plate 1400*b* in relation to the construction set component, so for example, edges of both the lock plate 1400*b* and construction set component align. The protrusions 1408 reside about openings 1402. At least one protrusion 1408 can be configured to prevent rotation of the lock plate 1400*b* in relation to another construction set component when received in an opening thereof.

The lock plate 1400*b* is provided with demarcations 1410, formed by an indentation, notch, perforation, printed mark or otherwise, that define adjacent segments 1412 of the bearing plate 1400*b*. The demarcations 1410 additionally facilitate reconfiguration of the bearing plate 1400*b*, for example, by indicating where the hearing plate 1400*b* can be bent or cut, reducing the strength of the bearing plate 1400*b* to facilitate bending or cutting and/or substantially preventing formation of sharp corners as discussed above with reference to other construction set components.

As shown in FIG. 14C, openings 1402 in either lock plate 1400*a* and 1400*b* may toe spaced in multiples of the spacing between openings 204 of other components of the construction set, and such that when the lock plate 1400*a* or 1400*b* is affixed to another component with fasteners through openings 1402, the shaft engaging opening 302 is substantially centered over an opening 204. Additionally, the lock plate 1400*a* and 1400*b* may include chamfers 206 to substantially eliminate sharp corners to prevent injury to a user.

The lock plate 1400*a* or 1400*b* may be composed of material that is harder than that of the drive shaft 1302 to prevent wear to the lock plate 1400*a* or 1400*b* or softer than the drive shaft 1302 to prevent wear to the shaft. Furthermore, the lock plate 1400*a* or 1400*b* may have a height dimension that is less than or equal to the height dimension of a bar 200 (FIG. 2A), so that when the lock plate 1400*a* or 1400*b* is affixed to the bar 200 or other similar component, the lock plate 1400*a* or 1400*b* does not substantially extend past the edges of the bar 200. Additionally, such a height dimension can correspond to the dimension of the segments 201 (for example FIG. 3A) of the construction set components. Therefore, when the lock plate 1400*a* or 1400*b* is affixed to plate, such as plate 300 of FIG. 3A, it does not substantially extend past the boundaries of the segments or interfere with adjacent openings, such as openings 204.

Figure 15B:
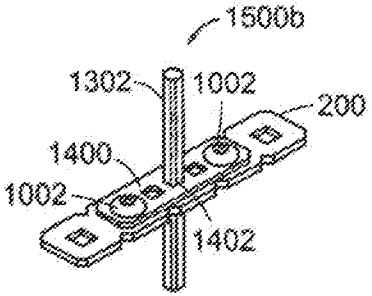
FIGS. 15A and 15B illustrate an exemplary configuration of the locking bar of FIG. 14 being coupled to the bar of FIG. 2A and shaft of FIG. 13.
Figure 15A:
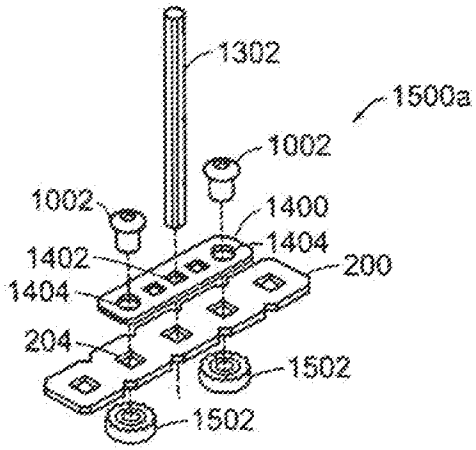

FIGS. 15A and 15B illustrate an exemplary configuration 1500*a* and 1500*b* of the lock plate 1400 of FIG. 14 being coupled to the bar 200 of FIG. 2A and shaft 1302 of FIG. 13. The lock plate 1400 may be coupled to the bar 200 via the openings 1404 of the lock plate 1400 being aligned with the openings 204 of the bar 200 and fastening the lock plate 1400 and bar 200 with fasteners 1002 and lock nuts 1502. At least one of the openings 1402 is to be aligned with one of the openings 204 to enable the drive shaft 1302 to extend through the openings 1402 and 204. The lock plate 1400 engages the drive shaft 1302 by the opening 1402 fixedly engaging the drive shaft 1302 so that the coupling of the lock plate 1400 to the bar 200 rotates the bar 200 as the lock plate 1400 is rotated by the drive shaft 1302. Additionally, the lock plate 1400 provides structural support at the rotation junction of the shaft to the bar 200. It should be understood that the lock plate 1400 may be coupled to other components of the construction set having openings that align to the openings 1404 and 1402 of the lock plate 1400. It should further be understood that the lock plate 1400 may be sized and shaped differently to be in accordance with other components of the construction set and provide for the same functionality (i.e., to enable rotation or translation of construction set components).

FIG. 15B shows a configuration 1500*b* of the lock plate 1400 being coupled to the bar 200 via the fasteners 1002 so as to enable the drive shaft 1302 to drive the bar 200 in a rotatable manner. As the drive shaft 1302 is rotated manually via a crank (not shown) or electromechanical drive (e.g., motor) (not shown), the lock plate 1400, being secured to the bar 200 via the fasteners 1002, causes the bar 200 to rotate.

FIG. 15A is an exemplary bearing or bushing plate 1600*a* for use in constructing a user-definable apparatus 100, such as that FIG. 1. FIG. 15A is a front view. The appearance of the bottom surface may be substantially the same. The bearing plate 1600*a* includes at least one hearing opening 1602 disposed between openings 204 located towards each end of the bearing plate 1600*a*. The bearing opening(s) 1602 may be substantially circular to support and allow a shaft 1302 to rotate freely. The openings 204 may be shaped and spaced substantially similar to the openings of other components, such as the bar 200 of the construction set, to enable the bearing plate to be coupled thereto. An exemplary bearing plate 1600 has round bearing openings 1602 that closely receive and support the drive shaft 1302 for smooth rotation therein, in contrast to the less smooth rotation provided by other openings that are not dimensioned to closely receive the drive shaft 1302. The bearing openings 1602 can be configured to substantially prevent contact of the drive shaft 1302 with an interior of an opening, such as opening 204, that is substantially aligned with the bearing opening 1602. Furthermore, the bearing openings 1602 can be configured to allow a desirable degree of misalignment between the longitudinal axis of the drive shaft 1302 and the central axis of the bearing opening 1602.

Figure 16B:
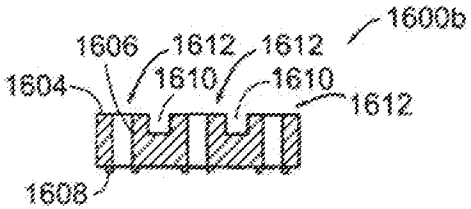
FIGS. 16A and 16C illustrate an exemplary component configured as a bearing or bushing plate for use in constructing a user-definable apparatus, such as that FIG. 1.
Figure 16C:
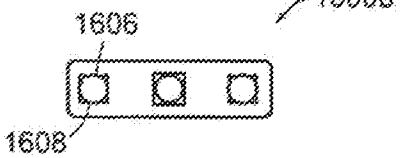
Figure 16A:
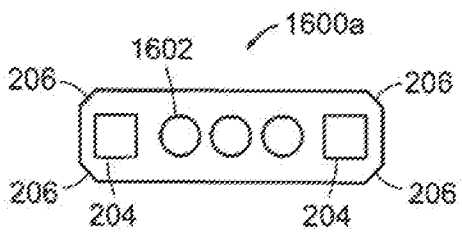

FIGS. 16B-16C provide another exemplary bearing plate 1600*b* that include multiple openings 1606 extending through the bearing plate 1600*b*. Each of the openings 1606 are sized both to receive a fastener (e.g., fastener 1002 of FIG. 17A) and to receive and support a drive shaft (e.g., drive shaft 1302 of FIG. 17A). Raised portions 1604 may include openings 1606 that may be disposed in relation to openings 204 of other components of the construction set. Each opening includes sidewalls that may or may not be threaded to allow a fastening component to secure the bearing plate 1600*b* to another component of the construction set. To simplify alignment and fastening of the bearing plate 1600*b* to another component of the construction set, protrusions 1608 extending from the bottom of the bearing plate 1600*b* may be provided. The protrusions 1608 are configured to engage the interior of openings, such as openings 204, of other construction set components to align openings 1606 to substantially coincide and, in an exemplary embodiment, be centered therewith. Further, the protrusions 1608 may further engage an interior of an opening to prevent rotation of the bearing plate 1600*b* with respect to the opening and the component to which the bearing plate 1600*b* is secured. The bearing plate 1600*b* may be composed of plastic or other material having a hardness index value lower than the hardness index value of the drive shaft 1302 to reduce wear to the drive shaft 1302 during rotation. The bearing plate 1600*b* is provided with demarcations 1610, formed by an indentation, notch, perforation, printed mark or otherwise, that define adjacent segments 1612 of the bearing plate 1600*b*. The demarcations 1610 additionally facilitate reconfiguration of the bearing plate 1600*b*, for example, by indicating where the bearing plate 1600*b* can be bent or cut, reducing the strength of the bearing plate 1600*b* to facilitate bending or cutting, and/or substantially preventing formation of sharp corners as discussed above with reference to other construction set components. It should be understood that the bearing plates 1600*a* and 1600*b* may be shaped different to conform to other components of the construction set and perform substantially the same function.

Figure 17B:
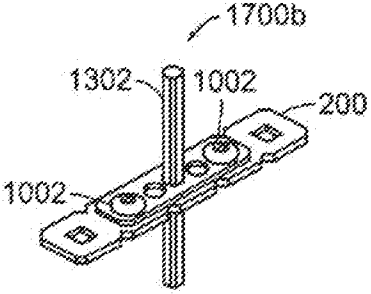
FIGS. 17A and 17B illustrate exemplary configurations of the bearing plate of FIG. 16A being coupled to the bar of FIG. 2A and shaft of FIG. 13.
Figure 17A:
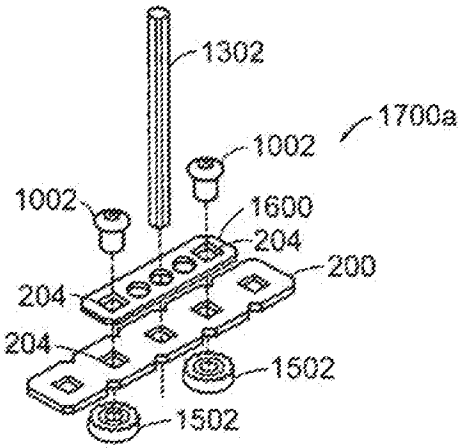

FIGS. 17A and 17B illustrate exemplary configurations 1700*a* and 1700*b* of the bearing plate 1600*a* as coupled to the bar 200. The openings 204 of the bearing plate 1600*a* are spaced in multiple increments of the spacing between the openings 204 of the bar 200 and the bearing opening 1602 is disposed between the openings 204 and aligned with the opening 204 of the bar 200 to enable the drive shaft 1302 to extend through the opening 1602 of the bearing plate 1600*a* through the opening 204 of the bar 200. It should be understood that the openings 204 and 1602 of the bearing plate 1600*a* may also be designed to align with openings of other components of the construction set. Fasteners 1002 and 1502 may be utilized to secure or couple the bearing plate 1600*s* to the bar 200. The bearing plate 1600*a* may be composed of metal or plastic. In the case of a metal bearing plate 1600*a*, the hardness index of the metal may be higher than that of the drive shaft 1302 so as to substantially avoid wear to the bearing plate 1600*a* as the drive shaft 1302 may be replaced, according to the principles of the present invention. Alternatively, the bearing plate 1302 may be composed of plastic having a lower index of hardness than the drive shaft 1302 so as to prevent wear to the shaft.

Figure 18A:
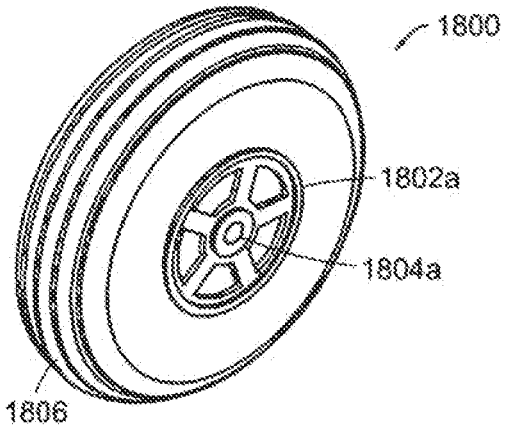
FIGS. 18A and 18B illustrate the left and right side of a wheel with hubs having circular and non-circular openings disposed therein, respectively, for use in constructing a user-definable apparatus, such as that of FIG. 1.
Figure 18B:
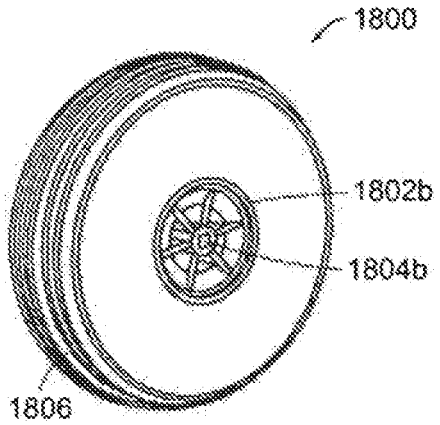

FIGS. 18A and 18B are illustrations of the left and right side of a wheel 1800, respectively, having hubs 1802*a* and 1802*b* (collectively 1802) extending therethrough for use in constructing user-definable apparatus, such as that of FIG. 1. As shown in FIG. 18A, the hub 1802*a* includes an opening 1804*a* centrally disposed. A tire 1806 composed of foam or other material may be disposed on and frictionally engage the hub 1802. FIG. 18B shows the hub 1802*b* having an opening 1804*b* that is substantially square to engage a non-circular shaft and prevent rotation thereof relative to the wheel 1800. Alternatively, the opening may have any other non-circular or polygonal shape to engage a non-circular shaft. Each of the hubs 1802 have coupling elements (not shown) operable to secure or fasten each hub 1802*a* and 1802*b* to one another to form the wheel 1800. Alternatively, the hubs 1802*a* and 1802*b* may be bonded together, for example, with adhesive.

In operation, the opening 1804*a* has a larger minimum dimension than the largest diagonal dimension of the opening 1804*b* so that the drive shaft 1302 may extend through the opening 1804*a* without obstruction. The opening 1804*b* may be configured to frictionally retain the drive shaft 1302, for example, by having ribs or other elastically compressible structure disposed on the internal surface to compress around the drive shaft 1302. The hub 1802 may be composed of a thermoplastic material. The wheel 1800 may provide a rotational motion for a structure to be moved by a motor coupled to a shaft engaging the opening 1804*b*, as understood in the art. Alternatively, the wheel 1800 may provide rotational motion for other functionality for user-definable structure. For example, the wheel 1800 may be utilized to translate sheets of paper.

Figure 19A:
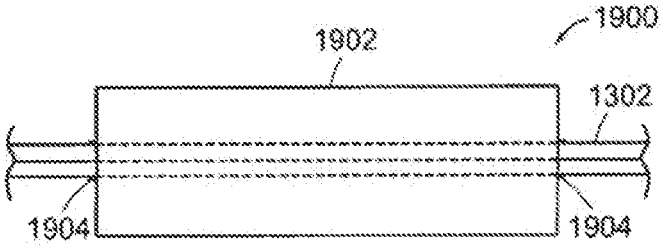
FIGS. 19A and 19B illustrate an exemplary roller for use in constructing a user-definable apparatus, such as that of FIG. 1.
Figure 19B:
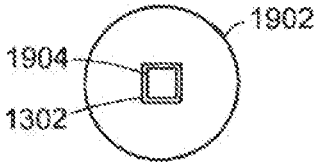

FIGS. 19A and 19B are illustrations of an exemplary roller configuration 1900 for use in constructing a user-definable apparatus, such as that of FIG. 1. A roller 1902 is designed to receive the drive shaft 1302 axially through the center of the roller 1902 and to frictionally engage the drive shaft 1302 therein. The roller 1902 may be composed of a compressible foam rubber or other resilient material. A plastic core 1904 may be adapted to receive the drive shaft 1302 and support the roller 1902 on the outside of the plastic core 1904. The plastic core 1904 may form a hub at the respective ends of the roller 1902. In operation, upon turning of the drive shaft 1302, the roller 1902 turns in relation to the rotation of the drive shaft 1302. The roller 1902 may be utilized for, among other purposes, picking up halls or other objects or equipment that may be desired to be collected by an electromechanical or robotic device constructed using the component of the construction set by a user.

Figure 20A:
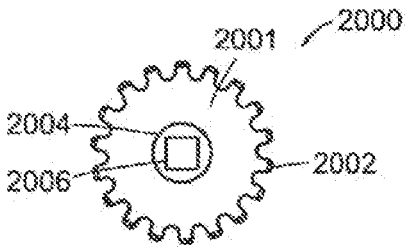
FIGS. 20A-20C illustrate an exemplary gear having a non-circular opening for use in coupling with the shaft of FIG. 13 in constructing a user-definable apparatus, such that of FIG. 1.
Figure 20B:
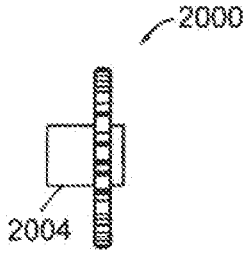
Figure 20C:
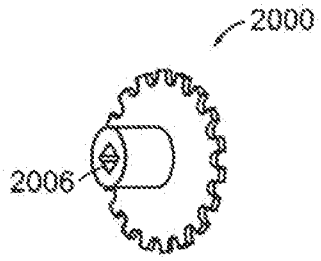

FIGS. 20A-20C illustrate an exemplary sprocket or gear 2000 having a circular frame 2001 with a plurality of teeth 2002 extending radially from the circumference of the frame 2001. As shown in FIG. 20A, a hub 2004 is coupled to and disposed substantially in the center of the circular frame 2001 as shown in FIG. 20B. The hub 2004 further extends axially from the center of the frame 2001. An opening 2006 is disposed in the center of the circular frame 2001 that is shaped to frictionally retain the drive shaft 1302. As shown, the opening 2006 is substantially square, hut other non-circular shapes may be utilized depending on the shape and/or dimensions of the drive shaft 1302. The opening 2006 may include compressible ribs (not shown) extending axially along the internal surfaces to fictionally engage the drive shaft 1302. Other compressible structures may be utilized to frictionally retain the drive shaft 1302 according to the principles of the present invention. The material of the sprocket may be of a self-lubricating thermoplastic, but other materials may also be utilised. The diameter of the circular frame 2001 may be of any size to enable a user to construct a structure to perform certain operations, such as increasing or decreasing rotational velocity via a gear train by having different gear ratios. Additionally, the number and size of the teeth 2002 may be varied for design purposes.

Figure 21A:
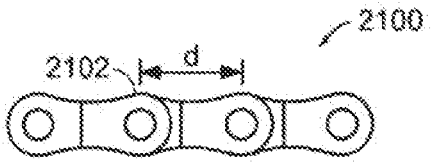
FIGS. 21A and 21B illustrate an exemplary chairs for use in constructing a user-definable apparatus, such as that of FIG. 1.
Figure 21B:
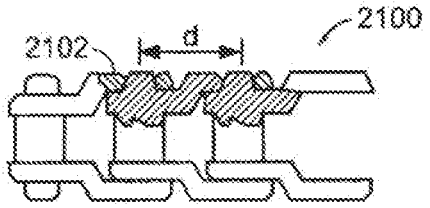

FIGS. 21A and 21B illustrate respective exemplary side and top portions of a chain 2100 for use with the sprockets 2000 of the construction set. The chain 2100 had the plurality of master chain links 2102 that are interchangeably attached, one link to another, such that to remove the chain link 2102, one may twist the chain or otherwise forcefully separate the desired chain link 2102. It should be understood that the chain 2100 may be any predetermined length and allow for a user to change the length by removing chain links 2102. The chain 2100 may be composed of any material. In one embodiment, the chain 2100 is composed of thermoplastics to match the material of the sprockets 2000, if formed of thermoplastic material. The center-to-center distance (d) between the chain links 2102 is set such that the teeth 2002 of the sprockets 2000 readily fit between each link 2102 of the chain 2100 and successively move links over the teeth 2002 of the sprocket 2000 as the chain moves.

Figure 22:
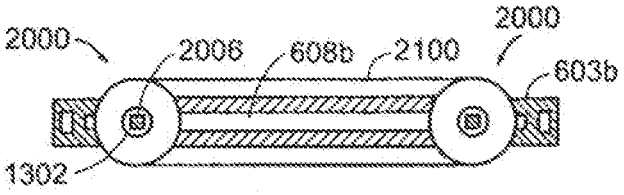
FIG. 22 illustrates multiple gears of FIG. 20A being driven by the chain of FIGS. 21A and 21B.

FIG. 22 is an exemplary configuration of sprockets 2000 being coupled via the chain 2100. As shown, the sprockets 2000 may allow one sprocket 2000 to be driven by a shaft 1302 extending through the opening 2006. In one embodiment, the drive shaft 1302 may be driven by a motor (not shown). Alternatively, the shaft may be driven by a crank operated by a user as understood in the art. Still yet, rather than using the chain 2100, the sprockets 2000 may be engaged directly via the teeth 2002 so that a sprocket 2000 being driven by a shaft to translate the rotation into the second sprocket 2000. It should be understood that other configurations for driving gears of the same or different sixes may be utilised in accordance with the principles of the present invention as understood in the art. The sprockets 2000 may be supported from a drive shaft to the bar-slide angle segment 603*b* via the slot opening 608*b*. By fastening the sprockets 2000 in the slot opening 608*b* or another opening in the same or different component that provides for continuous adjustment, tension of the chain 2100 may be adjusted by sliding one or both sprockets 2000 that engage the chain 2100.

Figure 23:
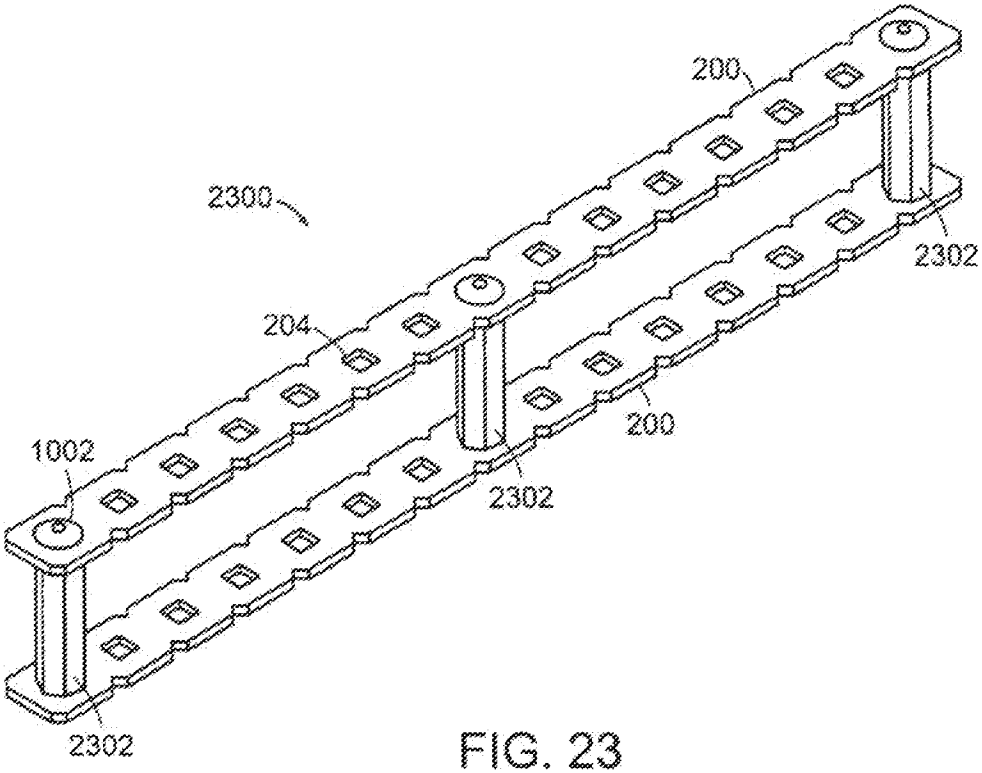
FIG. 23 illustrates an exemplary configuration of multiple bars of FIG. 2A being spaced by spacers with fastener openings for use in constructing a user-definable apparatus, such as that of FIG. 1.

FIG. 23 is an illustration of an exemplary configuration 2300 of multiple bars 200 of FIG. 2A being spaced by spacers 2302 for use in constructing a user-definable apparatus 100, such as that of FIG. 1. The spacers 2302, generally known as stand-offs, are operable to provide structural support for mechanical components, such as the bars 200, plates 300 and 500, and other components of the construction set. It should be understood that the spacers 2302 may be utilised in a construction set that does not provide components being designed to be alterable.

The spacers 2302 are shown to be hexagonal in shape and have threaded openings (not shown) on each end of the spacers 2302 extending axially into the spacers 2302. The threaded openings enable fasteners 1002, such as screws, bolts, and the like, to fasten the spacers 2302 with components of the construction set having openings (e.g., openings 204). Screws, such as hex screws, may be utilised to secure another construction set component, such as the bar 200, to the threaded spacer 2302. The spacers 2302 provide for increased user-design capability and variability of structures using the components of the construction set. The spacers 2302 provide for vertical (z-plane) expansion and construction. When multiple spacers 2302 are used to join construction set components in a configuration similar to that in FIG. 23, significantly strong and light structures are formed. Additionally, multiple sized spacers 2302 may be included in the construction set to provide additional variability in the design of structures. The spacers 2302 may be off-the-shelf components having openings with threads that are sized to receive fasteners for securing the spacers 2302 to other components.

It should be understood that the square openings associated with the mechanical components provide functional value, but also are ornamental in nature. It should be appreciated that the geometry for the openings (e.g., opening 204) and shaft 1302 could have been another shape, such as a hexagon, and produced the substantially same functionality. By making the openings consistently substantially square (with rounded corners), a separate and distinct ornamental value is established with consumers of the construction set.

It should be understood that each of the construction set components described herein can be formed from metal, plastic, or other material. Though not necessary for the concepts of this invention, the material can be plastically deformable without substantially breaking. One such material is cold roiled steel. If such a plastically deformable material is desired, care must be taken when constructing the components from plastic as most plastics that are rigid enough for forming construction set components are not plastically deformable without substantially breaking.

Electromechanical Components

Figure 24A:
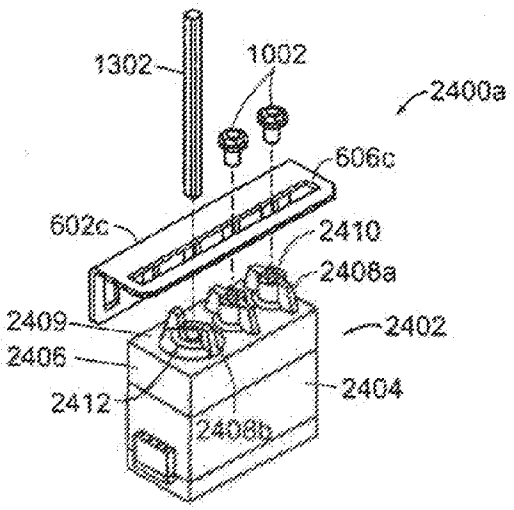
FIGS. 24A-24I illustrate an exemplary housing of an electromechanical drive assembly, such as a motor or servo, for use in constructing a user-definable apparatus, such as that of FIG. 1.

FIG. 24A illustrates an exemplary configuration 2400*a* having an electromechanical drive assembly 2402, including a motor, servo or other device operable to translate electrical energy into motion 2403 (FIG. 24B), for use in constructing a user-definable apparatus 100, such as that of FIG. 1. The electromechanical drive assembly 2402 includes a housing 2404 and a housing attachment 2406 that at least partially support and encase the motor 2403. The housing attachment

Figure 24B:
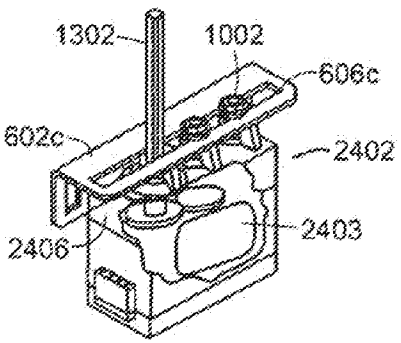

2406 may include stand-offs 2408*a* and 2408*b* that are operable to maintain a component (e.g., bar-slide angle portion 602*c*) at a distance from a front surface 2409 of the housing attachment 2406. The stand-offs 2408*a* may include a wing section and center section. Above the center section, a protrusion 2410 extends therefrom. The stand-offs 2408 may be spaced to correspond to the spacing between openings D. At least one protrusion 2410 is sized and shaped to be closely received in an opening of a component, such as the slot opening 608*c* of the oar-slide angle portion 602*c* or the opening 204 of another construction set component, and substantially prevent movement of the housing attachment 2406 in relation to the component. The protrusion 2410 can have a non-circular exterior profile that engages a non-circular opening 204 or slot 608*c* to prevent lateral movement and rotation about the axis of the protrusion 2410. As shown in FIG. 24B, a flat edge of at least one of the protrusions 2410 engages a flat edge on an interior of the slot opening 608*c* to align the electromechanical drive assembly 2402 in relation to the slot opening 608*c*.

As shown, the slot opening 608*c* is substantially parallel to an edge of the bar-slide angle portion 602*c*. When at least one of the protrusions 2410 is received in the slot opening 608*c*, an edge of the exterior of the electromechanical drive assembly 2402 is aligned with the edge of the bar-slide angle portion 602*c* and the electromechanical drive assembly 2402 is substantially prevented from rotating in relation to the bar-slide angle portion 602*c*. Furthermore, the drive shaft 1302 associated with the electromechanical drive assembly 2402 may be substantially centered in the slot opening 608*c* so as not to substantially contact the sides of the opening. The slot opening 608*c* can be provided in various positions to affect different alignment of the electromechanical drive assembly 2402 to the bar-slide angle portion 602*c*. Similar alignment and engagement can be achieved with holes 204 and other components in the construction set. Likewise, in the case of holes 204, the drive shaft 1302 and the protrusions 2410 can be configured to substantially center the drive shaft 1302 in a hole 204.

The stand-off 2408*b* includes two wing sections that extend from the housing attachment 2406. The stand-offs 2408*a* and 2408*b* may be spaced to have substantially the same spacing as openings of another component of the construction set for alignment purposes. In one embodiment; the stand-offs 2408*a* and/or the protrusions 2410 are internally threaded to threadingly receive a fastener (e.g., fastener 1002 of FIG. 24B). Alternatively, the stand-offs 2408*a* and/or the protrusions 2410 may incorporate a male fastener 2418 (FIG. 24G) that extends outward from the housing, attachment 2406. In another exemplary embodiment, the stand-offs 2408*a* and/or protrusions 2410 can be integrated with a fastening device, such as a snap mechanism 2420 (FIG. 24H) that deforms to insert through one or more openings in a construction set component and snaps hack to engage the construction set component to retain the housing attachment 2406 in relation thereto. By mounting a bar-slide angle to the stand-offs 2408, the component to the stand-offs 2408*a* and 2408*b* of the electromechanical drive assembly, alignment tolerances may be relaxed.

The electromechanical drive assembly 2402 may include a socket or drive port 2412 operable to receive the drive shaft 1302 and rotate the drive shaft 1302 about an axis. The socket 2412 may be disposed toward an end of the electromechanical drive assembly to be compliant with conventional electromechanical drive assemblies having a gear system in the center of electromechanical drive assembly. The socket 2412 may be spaced a distance D from an adjacent standoff 2408. The housing attachment 2406 and/or housing 2404 may be about at least part of the socket 2412. FIG. 24A shows the socket 2412 substantially completely contained within the housing 2404 and housing attachment 2406. Furthermore, one stand-off 2408*b* may be positioned about the socket 2412 and extend along an axis substantially parallel to the axis that the drive shaft 1302 is rotated about. The socket 2412 may be utilized to releasably retain the drive shaft 1302 by having an interference fit or elastomeric sleeve that deforms about the drive shaft 1302 to frictionally retain the drive shaft 1302 in the socket 2412 without having to use a fastening component, such as a pin or screw, to maintain the drive shaft 1302 in the socket 2412 of the electromechanical drive assembly 2402. Therefore, because the drive shaft 1302 is releasably retained, one drive shaft 1302 may be interchanged with another, different drive shaft 1302.

The socket 2412 is non-circular and may be of any shape operable to rotate a shaft. For example, the drive shaft 1302 as shown in FIG. 24A has a substantially square profile and the socket 2412 can have at least one substantially planar surface operable to abut at least one substantially planar surface of the drive shaft 1302. The socket 2412 as shown in FIG. 24A has an internal square profile that receives the square external profile of the drive shaft 1302 and has four substantially planar surfaces that abut corresponding substantially planar surfaces of the drive shaft 1302. By providing a socket 2412 that abuts at least two surfaces of the drive shaft 1302, the socket 2412 can support the drive shaft 1302 in relation to the axis.

It is within the scope of the principles of the present invention that the socket 2412, rather than being substantially within the housing as depicted in FIG. 24A, be provided in another component, for example in an end of a drive shaft that extends from the electromechanical drive assembly 2402.

FIG. 24B illustrates a configuration 2400*b* of the electromechanical drive assembly 2402 engaging the bar-slide angle portion 602*c* utilizing fasteners 1002 extending through and engaging the stand-offs 2408*a* and 2408*b* extending from the housing attachment 2406. It should be understood that the housing attachment 2406 may be considered part of the housing 2404 of the electromechanical drive assembly 2402 when configured thereto. The drive shaft 1302 extends through the slot opening 608*c* of the bar-slide angle portion 602*c*.

Figure 24C:
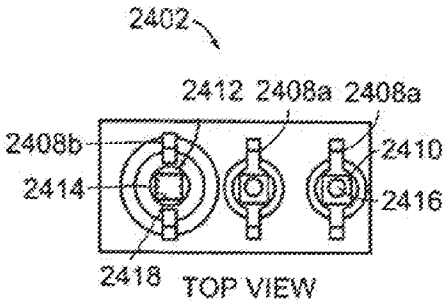
Figure 24D:
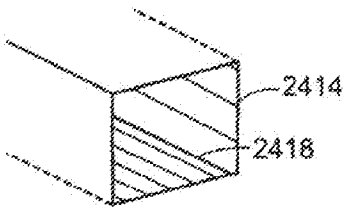
Figure 24F:
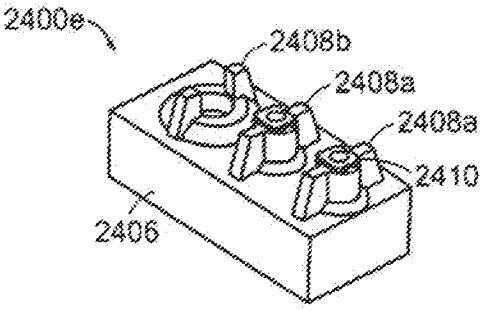

FIG. 24C is a top view of the electromechanical drive assembly 2402. As shown, the stand-offs 2408*a* and 2408*b* are spaced at regular intervals for being coupled to components (e.g., bar 200) having openings at regular intervals. The stand-offs 2408*a* each include substantially square protrusions 2410 having an outer surface operable to engage inner surface of an opening of a component e.g., opening 204 of bar 200). The stand-offs 2408 further include an opening 2416 extending radially therein. The openings 2416 may include threads to enable a fastener to screw into the opening 2416. As shown, the socket 2412 includes a substantially square profiled opening 2414 having ribs 2418 being elastically compressible extending axially along the inside surface of the opening 2414. It should be understood that the opening 2414 may have a profile other than square that engages a non-circular shaft for drive or moving a component of the construction set. As shown in FIG. 24D, the opening 2414 of the socket 2412 is shown to have the ribs 2418 extending axially into the socket to elastomerically and frictionally retain the drive shaft 1302. Other elastically deformable structures alternatively may be utilized.

Figure 24E:
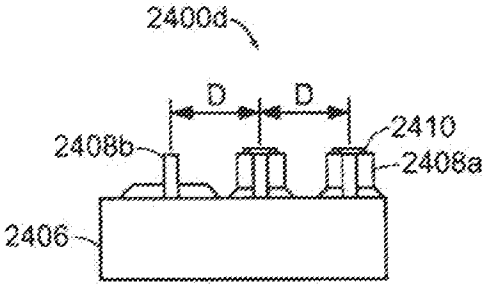
Figure 24H:
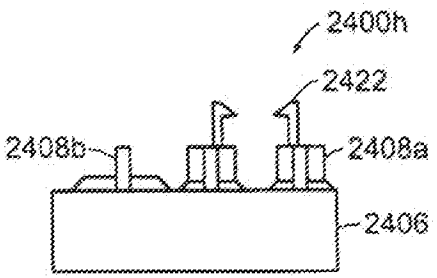
Figure 24G:
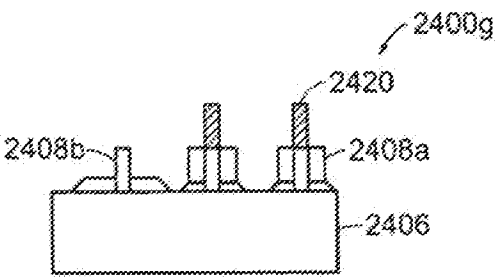

FIG. 24E is an exemplary housing attachment 2406 that may be conformed to engage an existing housing, such as the housing 2404, or other housing attachment. The housing attachment 2406 is shown to have the stand-offs 2408*a* and 2408*b* and protrusions 2410 that are utilized to align the electromechanical drive assembly 2402 to a component of the construction set.

FIG. 24F illustrates an exemplary housing attachment 2406 that may be utilized to be coupled to an electromechanical drive assembly 2402. Manufacturers of an electromechanical drive assembly may utilize the housing attachment 2406 by attaching the housing attachment 2406 to the electrochemical drive assembly to configure an existing electromechanical drive assembly design or a new electromechanical drive design for use in a construction set.

Figure 24I:
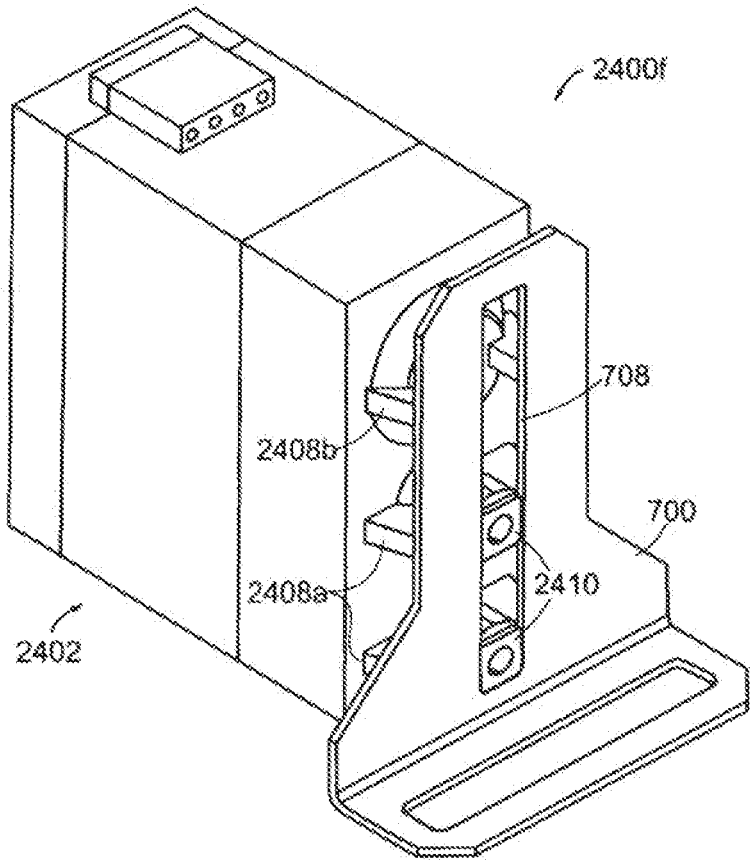

FIG. 24I illustrates another configuration 2400*f* of the electromechanical drive assembly 2402 engaged with the angle gusset 700. As shown, the protrusions 2410 extend into the slot opening 708 for aligning the electromechanical drive assembly 2402 with the angle gusset 700. The protrusions 2410 may frictionally fit the slot opening 708 to simplify construction.

Figure 25:
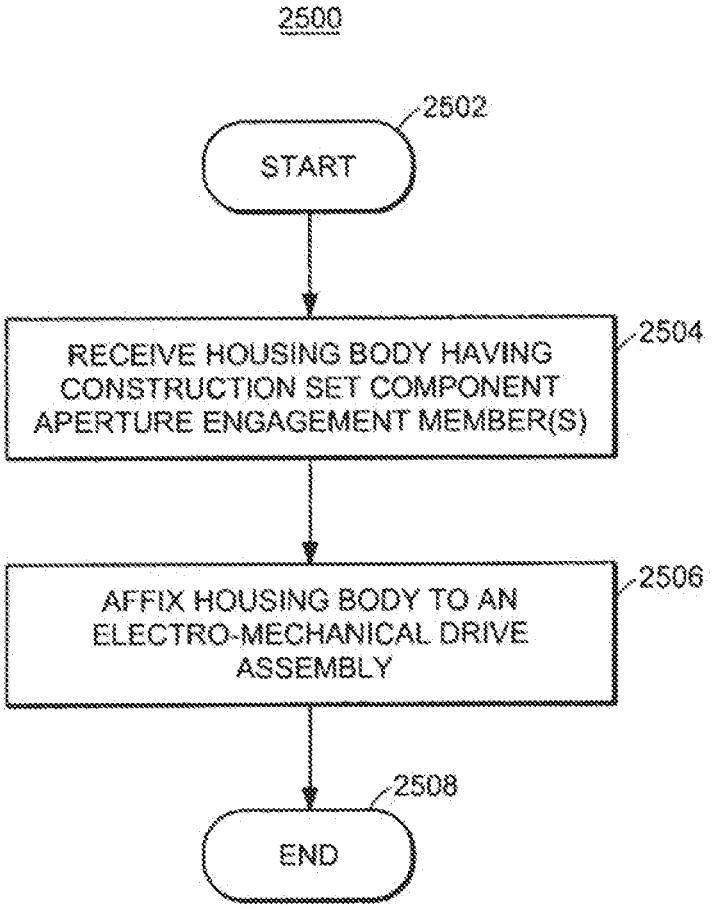
FIG. 25 is an exemplary flow chart for configuring the housing body having aperture engagement members), such as that shown in FIG. 24A, with an electromechanical drive.

FIG. 25 is an exemplary flow chart 2500 for configuring the housing 2404 having aperture engagement member(s) for example, protrusions 2410, such as that shown in FIG. 24A, with a component of the construction set. The process starts at step 2502. At step 2504, a housing body having construction set component aperture engagement member(s) is received. In one embodiment, the housing body is a housing attachment configured to be affixed to an existing housing body. At step 2506, the housing body received is affixed to an electromechanical drive assembly. In one embodiment, the electromechanical drive assembly includes a socket as shown in FIGS. 24A-24I. Alternatively, the electromechanical drive assembly may be an existing electromechanical drive assembly configured to be utilized as a servo or motor and having a male coupling element for a shaft to engage the electromechanical drive assembly. The motor may be a direct current (DC) motor as understood in the art. The housing attachment may be affixed by utilizing an adhesive or mechanical coupling component. In the case of the electromechanical drive assembly having a shaft that is substantially permanently coupled to the electromechanical drive assembly, an element extending from or fastened to the shaft may be removed for the housing body to be coupled to the electromechanical drive assembly. By attaching or affixing the housing body having at least one component aperture engagement member, such as a protrusion operable to engage an opening of a component of the construction set, engaging of the electromechanical drive assembly to components of the construction set may be substantially easier than utilizing an existing housing of the electromechanical drive assembly. The process ends at step 2508.

Figure 26:
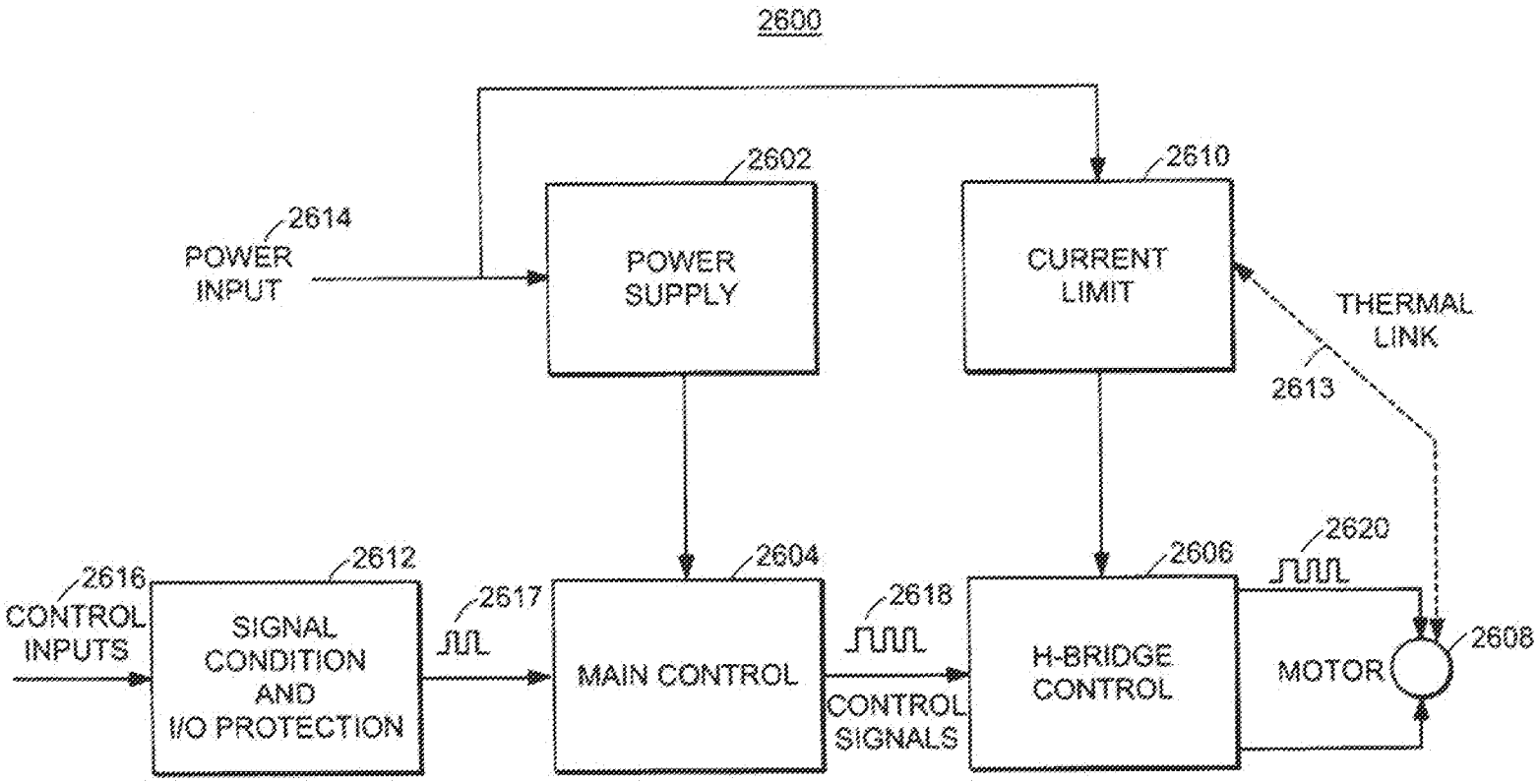
FIG. 26 is an exemplary block diagram providing an electrical architecture for controlling speed and direction of an electromechanical drive for use in constructing an apparatus from components of a construction set.

FIG. 26 is an exemplary block diagram 2600 providing an electrical architecture for controlling speed and direction of an electromechanical drive for use in constructing an electromechanical structure from components of a construction set. A power supply 2602 is coupled to a main controller 2604 for providing power thereto. An H-bridge controller 2606 is electrically coupled to the main controller 2604 and operable to drive an electromechanical drive 2608, such as a motor. A current limiter 2610 may be thermally coupled to the electromechanical drive 2608 and electrically coupled to the H-bridge controller 2606. A signal conditioning and I/O protection circuit 2612 may be coupled to the main controller 2604 and be operable to condition signals being input to the main controller 2604.

A power input device 2614 may be utilized to provide power to the power supply 2402 and current limiter 2610. The power input device 2614 may be a battery or transformer if receiving power from an external source. The power supply is utilized to drive the main controller 2604, which receives input via the signal condition and I/O protection circuit 2612 based on control input signals 2616 received from a remote controller (not shown) as understood in the art. In one embodiment, the remote controller may utilize radio frequency signals. Alternatively, the remote controller may utilize infrared or-other types of communication signals. By utilizing a remote control, an apparatus may be considered a remotely piloted vehicle. The signal condition and I/O protection circuitry 2612 may be utilized to condition the control input signal 2616 as understood in the art. The main controller 2604 may receive the conditioned control input signals 2617 and produce control signals 2618 that are operable to be utilised for controlling the electromechanical drive 2608 at variable speeds and directions. The H-bridge controller 2606 receives the control signals 2618 and drives the electromechanical drive 2608 with a drive signal 2620 to drive the electromechanical drive 2608.

The current limiter 2610 operates to limit the voltage and/or current to the electromechanical drive 2608 if the current being delivered to the electromechanical drive 2608 from the H-bridge controller 2606 exceeds a threshold value or the temperature of the electromechanical drive 2608 exceeds a threshold value. In one embodiment, the current limiter 2610 is electrically coupled in series to the power terminals 2704 of the electromechanical drive 2608 and thermally coupled to the power terminals (see FIG. 27) to sense both the current and the temperature of the electromechanical drive 2608 to limit the current being delivered from the H-bridge controller 2606 to the electromechanical drive 2608 by limiting the current through the current limiter 2610. External heating from the motor also causes the current limiter 2610 to limit current, and, thus, power being delivered to the electromechanical drive 2608. Reducing power to the electromechanical drive 2608 allows for cooling, which, in turn, causes the current limiter 2610 to stop limiting the current.

This current limiting is effective to maintaining operation of the electromechanical assembly 2402 because if too much current is supplied to the motor, such as may be produced by the electromechanical structure in which the electromechanical drive 2608 is operating under a heavy load and/or stall condition, the windings of the electromechanical drive 2608 tend to melt. If the windings melt, the electromechanical drive 2608 becomes dysfunctional or simply breaks.

Figure 27A:
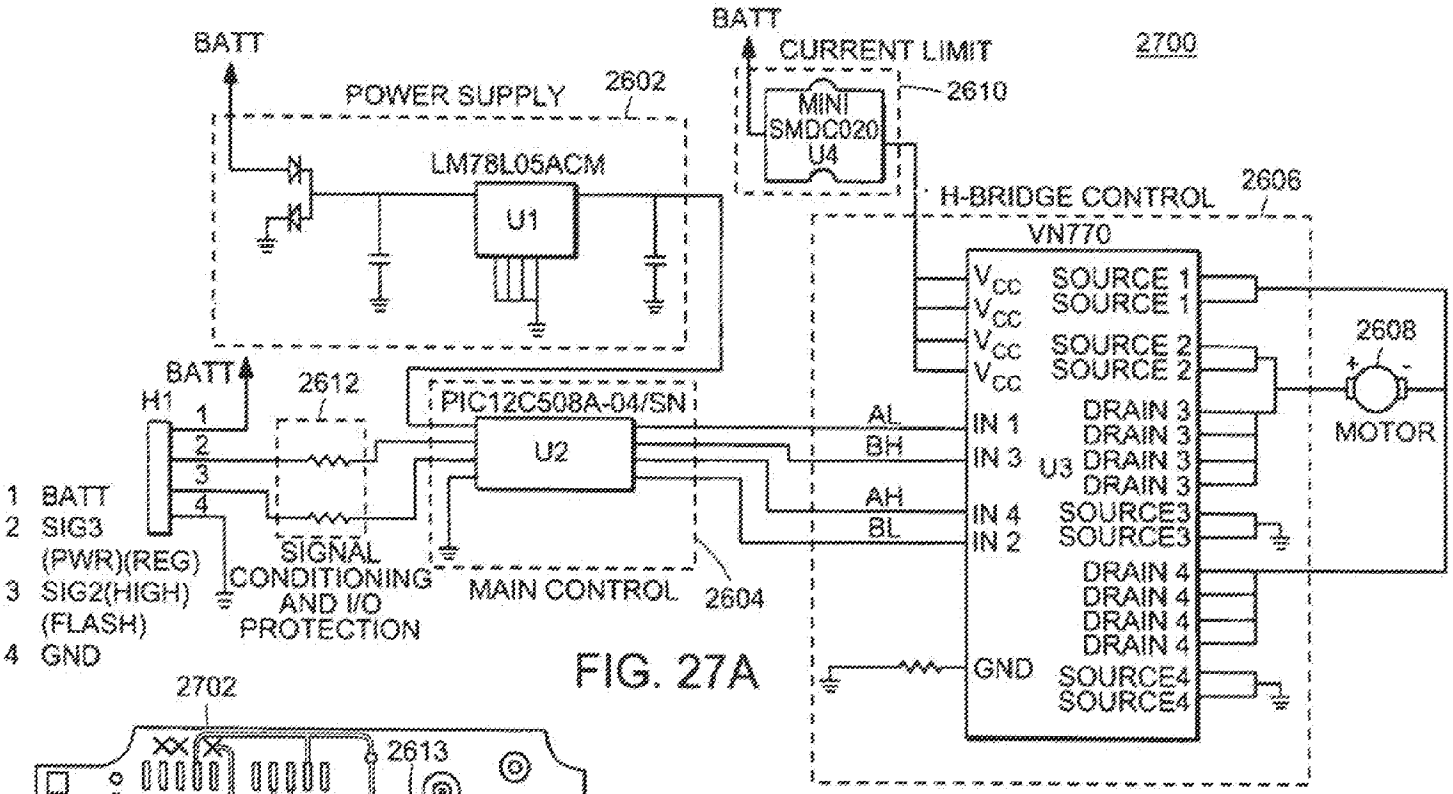
FIG. 27A is an exemplary electronic schematic for providing the variable speed and direction control provided by the block diagram of FIG. 26.

FIG. 27A is an exemplary schematic 2700 of the variable speed and direction control circuit provided by the block diagram 2600 of FIG. 26. The power supply 2602 may be configured to receive battery power or power from another source and regulate the power using a regulator VI operable to regulate the voltage provided to the main controller 2604 as understood in the art. One such regulator is an LM78Lxx series regulator. A header H1 may receive control input signals 2616 that include battery power BATT, commands Sig1 and Sig2 to control operation of the electromechanical drive 2608, and ground GND. The control input signals 2618 are received and conditioned by the signals conditioning and I/O protection circuit 2612, which may include signal conditioning electrical components operable to protect the main controller 2604 from receiving noisy signals and/or voltage or current spikes as understood in the art.

The main controller 2604, which includes a processor U2, receives the conditioned control inputs 2612 and generates the control signals 2618 based on the conditioned control inputs 2612. In one embodiment, the processor U2 may be a microcontroller PIC12Cxxx, that executes software operable to receive the control input signals 2616 and generate control signals 2618 that may include a pulse width modulated (PWM) signal to control the electromechanical drive 2608 at a variable speed within a range of speeds. TABLE 1 is an exemplary table that describes control input signals 28.16 and the resulting control signals 2618 generated by the main controller 2604 for control of the electromechanical drive 2608 in relay mode, which includes control of the electromechanical drive 2608 in neutral, full forward, and full reverse (i.e., without variable speed control).

TABLE 1

Main Controller Processing Results in Relay Mode

| INPUTS | | | OUTPUTS | | | |
|---|---|---|---|---|---|---|
| Sig1 | Sig2 | STATE | AH | BH | AL | BL |
| L | L | Neutral | L | L | L | L |
| H | H | Neutral | L | L | L | L |
| L | H | Full Fwd | H | L | L | H |
| H | L | Full Rev | L | H | H | L |

TABLE 2 is an exemplary chart describing operation of the main controller 2604 operating to provide variable speed and direction control utilising the H-bridge controller 2606 to drive the electromechanical drive 2608. As shown, the states include neutral, forward, full forward, reverse, and full reverse. The inputs (i.e., AH, BH, AL, and BL) may have the control signals 2618 generated by the main controller 2604. There are five different states, neutral, forward, full forward, reverse, and full reverse. In one embodiment, to drive the electromechanical drive 2608 in variable speed mode, a chopping or pulse width modulated signal is applied to the H-bridge controller 2606 with a duty cycle proportional to the desired speed. The chapping signal may be applied to either the high or low side terminals of the H-bridge controller 2606.

TABLE 2

Main Controller Processing Results in Variable Speed Control Mode

| INPUTS | | | | | OUTPUTS | |
|---|---|---|---|---|---|---|
| AH | BH | AL | BL | STATE | Mot (+) | Mot (−) |
| L | L | L | L | Neutral | L | L |
| H | L | L | Chop | FWD | Chop | L |
| H | L | L | H | Full FWD | H | L |
| L | H | Chop | L | REV | Chop | H |
| L | H | H | L | Full REV | L | H |

The H-bridge controller 2606 may include an H-bridge MOSFET configuration and/or other components and configurations as understood in the art to control the rate of speed and direction of the electromechanical drive 2608. In one embodiment, the H-bridge controller 2609 may utilize a VN770 component produced by STMicroelectronics™ Corporation. The H-bridge controller 2606 may receive power from the battery via the current limiter 2610. The current limiter 2610 uses a resettable electronic device U4. In one embodiment, the resettable electronic device U4 is a miniSMDC020 polyswitch surface-mount, resettable device produced by Raychem™ Corporation that operates as drive protection for the H-bridge controller 2606 and electromechanical drive 2608. One type of resettable electronic device suitable for use in limiting current based on temperature is generally known as a PTC current limiter.

The principles of the present invention provide for the controller 102 to include both a receiver and transmitter for two way communication of information between the controller 102 and another electronic device, such as a remote control or data acquisition device. In one embodiment, the information being transmitted from the controller 102 may be telemetry data corresponding to data measured from sensors or computed by the main controller 2604 or other processor. The telemetry data may be utilised to remotely monitor operation of the remotely piloted vehicle. For example, the telemetry data may include information relating to power, battery charge, motor angles, or other kinematic or electrical component operation. The telemetry data may be displayed using an LED, LCD, monitor, or otherwise to enable the user to remotely monitor the operation of the remotely piloted vehicle. It should be understood that the remotely piloted vehicle may be autonomous to operate at least partially without remote user input. Accordingly, the user may construct a robot as understood in the art and utilize a wireless communication link for communicating information to and from the robot.

Figure 27B:
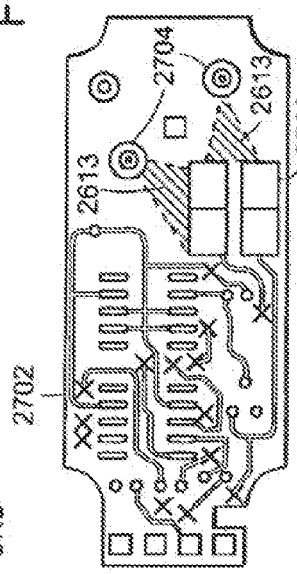
FIG. 27B is an exemplary mechanical schematic for limiting current to the electromechanical drive based on an overcurrent and/or over-temperature condition thereof.

FIG. 27B is an exemplary mechanical schematic of a printed circuit board 2702 for limiting current to the electromechanical drive based on an over-current and/or over-temperature condition thereof. As shown, the layout of printed circuit board 2702 include power terminals 2704 for the electromechanical drive 2808. Two thermal links 2613 couple the power terminals 2704 to pads 2706 that the current limiter 2610 is mounted. The thermal links 2613 may be composed of fiberglass, copper, metal, or any combination of printed circuit board material for transferring heat from the power terminals 2704 to the current limiter 2610.

Figure 28:
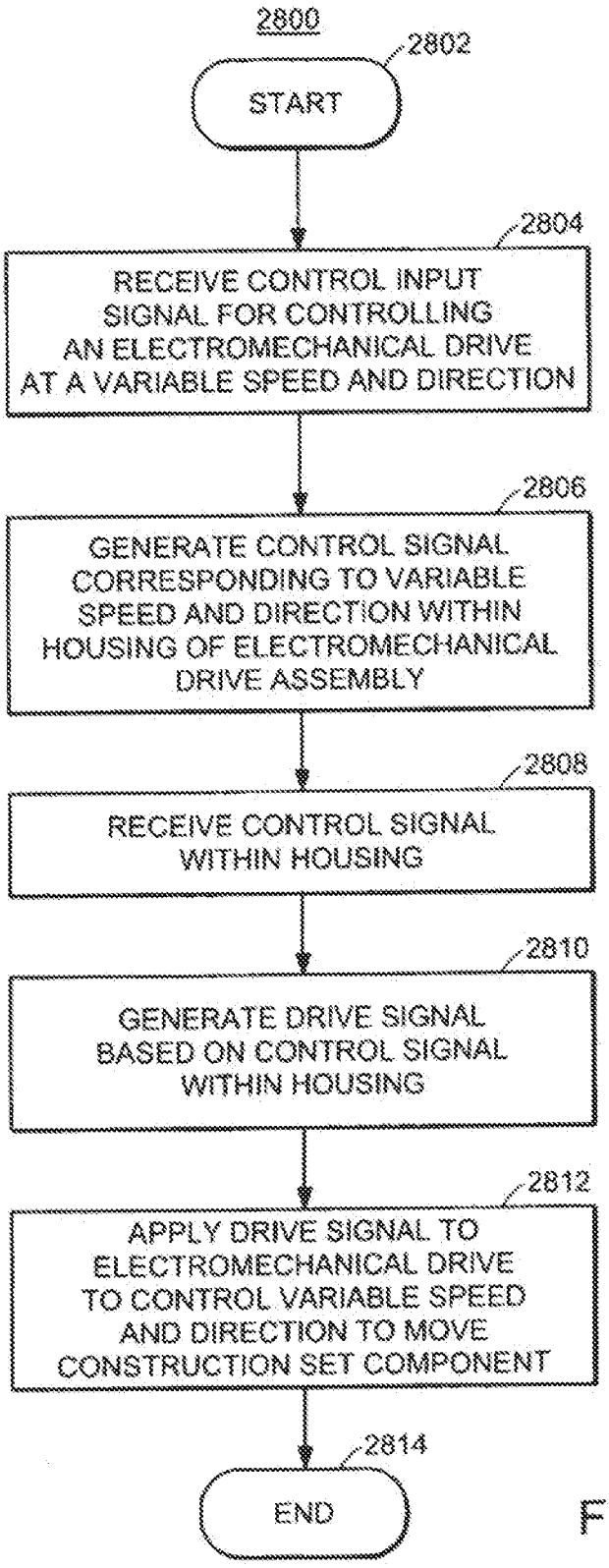
FIG. 28 is an exemplary flow diagram for controlling the electromechanical drive of the electromechanical drive assembly of FIG. 24A for an electromechanical structure constructed using the construction set.

FIG. 28 is an exemplary flow diagram 2800 for controlling the electromechanical drive 2608 of the electromechanical drive assembly 2402 of FIG. 24A for an electromechanical structure constructed utilizing the construction set. The process starts at step 2802. At step 2804, a control input signal 2816 is received for controlling the electromechanical drive 2608 at a variable speed and direction. At step 2806, a control signals 2618 corresponding to the variable speed and direction is generated within the housing 2404 of the electromechanical drive assembly 2402. The control signal 2618 is received within the housing 2404 at step 2808 and a drive signal 2620 is generated within the housing 2404 based on the control signal 2618 at step 2810. At step 2812, the drive signal 2620 is applied to the electromechanical drive 2608 to control variable speed and direction to move a component of the construction set. The process ends at step 2814.

Figure 29:
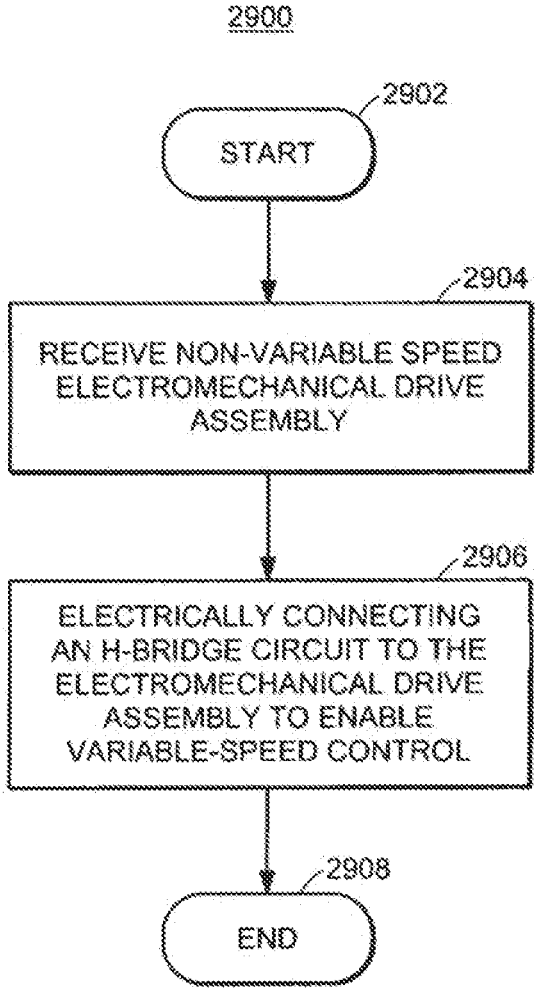
FIG. 29 is an exemplary flow chart for converting a non-variable speed electromechanical drive assembly to an electromechanical drive assembly for use with a construction set for constructing an electromechanical apparatus, such as that of FIG. 1.

FIG. 29 is an exemplary flow chart 2900 for converting a non-variable speed electromechanical drive assembly to an electromechanical drive assembly 2402 for use with a construction set for constructing an electromechanical apparatus. Because there are many existing servos and/or motors that are produced for builders of model electromechanical structures (e.g., model airplanes, vehicles, etc), the cost of the existing servos and/or motors is relatively low. However, these existing servos and/or motors are limited in that they are do not provide for variable speed control without having a separate variable speed controller, such as an H-controller. Therefore, the non-variable speed servos and/or motors provide for a viable commercial solution to be utilized for use in the construction set according to the principles of the present invention with some modifications. The modifications may include converting the non-variable speed electromechanical drive assembly to enable variable speed and direction. As previously discussed, other modifications may include affixing the housing attachment 2406 to an existing housing of the non-variable speed electromechanical drive assembly. Still yet, the male output assembly may be converted to include the female output socket 2412.

The manufacturing process for converting a non-variable speed electromechanical drive assembly to an electromechanical drive assembly 2402 starts at step 2902. At step 2904, a non-variable speed electromechanical drive assembly is received. An H-bridge circuit is electrically connected to the non-variable speed electromechanical drive assembly to enable variable-speed control of the electromechanical drive operating therein at step 2906. The process ends at step 2908.

Figure 30A:
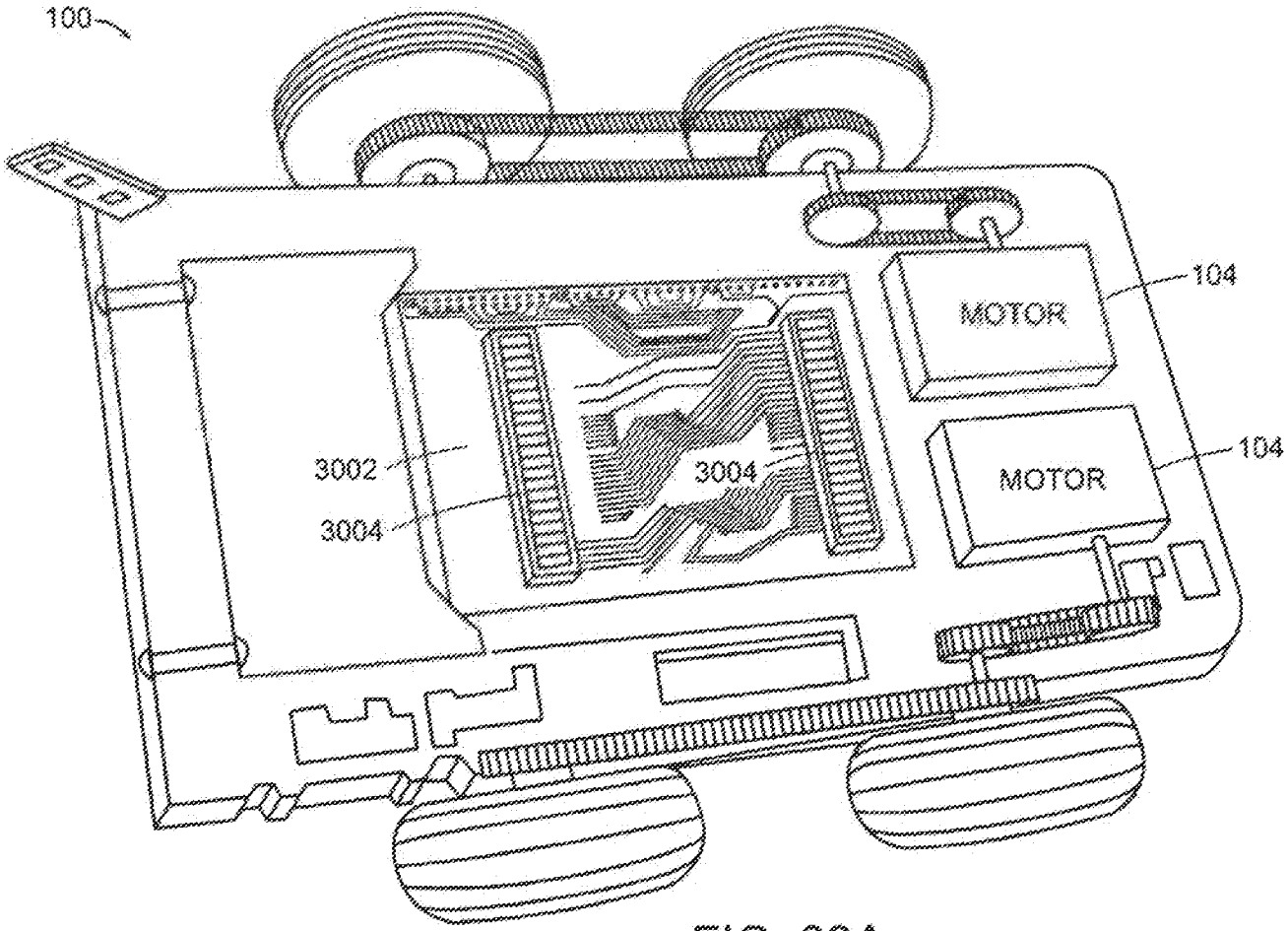
FIGS. 30A and 30B illustrate an exemplary user-defined apparatus without and with a controller, respectively, for controlling operation of the apparatus via electromechanical drive assemblies of FIG. 24A.
Figure 30B:
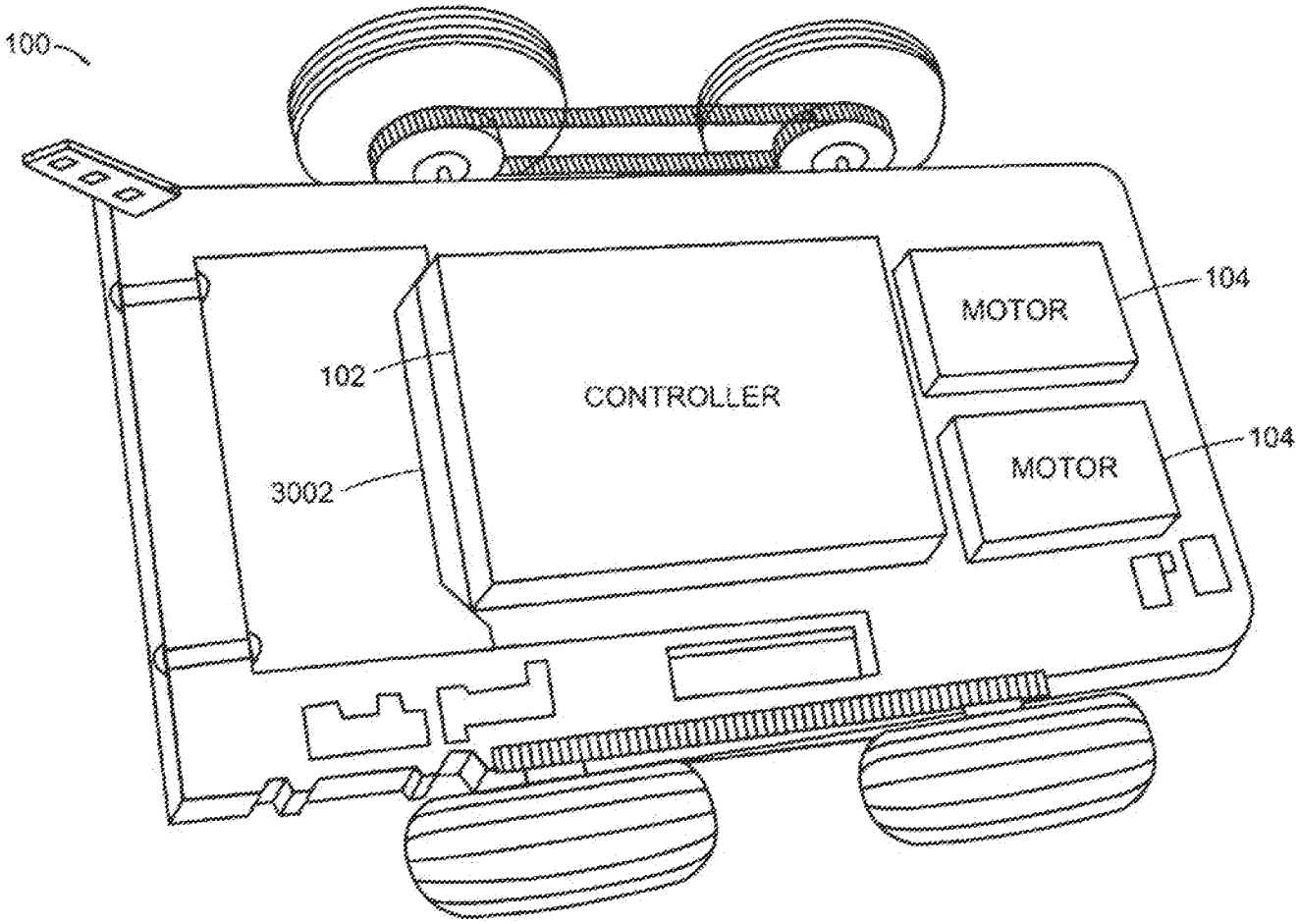

FIGS. 30A and 30B illustrate an exemplary user-defined apparatus 100 that is electromechanical, without and with the controller 102 for controlling operation of the apparatus via motors 104 of FIG. 24A. As shown, the electromechanical user defined apparatus 100 includes a motherboard 3002 for use in mounting, powering, and operating electronics as understood in the art. The motherboard 3002 includes two headers 3004 that the controller 102 may be mounted. By utilising a motherboard 3002 with headers 3004 operable to mount and power the controller 102, a user may construct multiple electromechanical structures with motherboard 3002 and utilise a single controller 102, which may be more expensive than the mechanical components, to operate and control the apparatus 100. As shown on FIG. 30B, the controller 102 may be installed onto the user defined apparatus 100 by simply connecting the controller 102 to the headers 3004, thereby allowing the user to control the user defined apparatus 100 via a remote, wireless controller.

Tools

The construction set may come complete with tools that may be utilized for altering, including resizing, reshaping, and/or reconfiguring mechanical components that may be utilized to form a user-definable structure. As discussed with regard to the bar 200, the bar 200 may be reshaped by being bent or cut to provide different components (i.e., a component having a different length and shape). Additionally, because the mechanical components are coupled to one another, tools provided with the construction component may be utilized to perform the coupling operations.

Figures 31, 32:
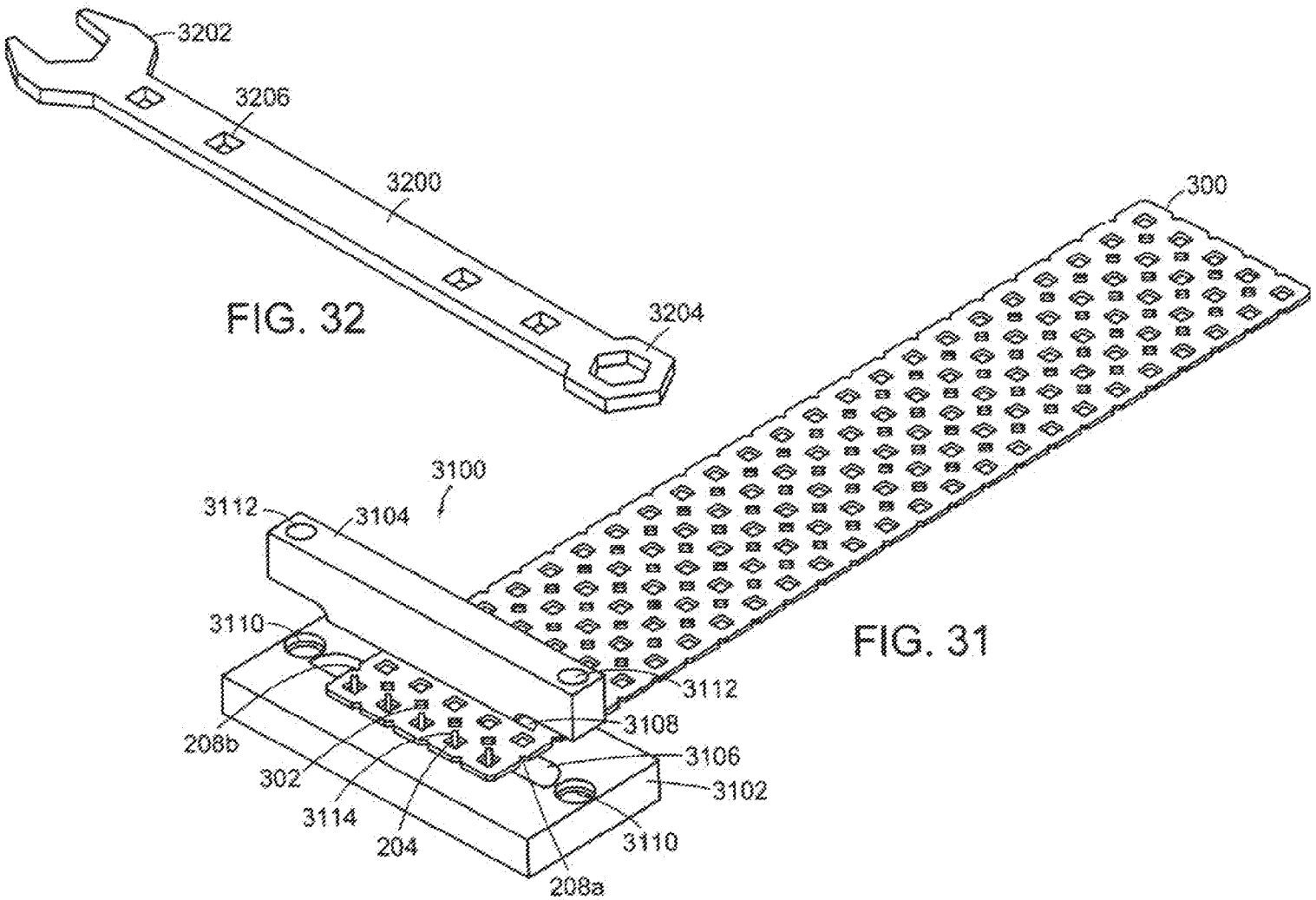
FIG. 31 is an exemplary break clamp for use in reconfiguring a component designed to be alterable for use in constructing a user-definable apparatus, such as that of FIG. 1.
FIG. 32 is another tool for use in constructing a structure, such as that of FIG. 1, with a construction set according to the principles of the present of the present invention.

FIG. 31 illustrates an exemplary break press clamp 3100 for use in reconfiguring a component designed to be alterable (e.g., bar 200) for use in constructing a user-definable apparatus 100, such as that of FIG. 1. The break press clamp 3100 includes a bottom portion 3102 and a top portion 3104. The bottom portion 3102 includes a substantially V-shaped notch 3106 spanning laterally across the bottom portion 3102. The top portion 3108 includes a substantially V-shaped portion 3108 extending from the top portion 3104 that is adapted to fit the V-shaped notch 3106 of the bottom portion 3102 of the break press clamp 3100. Adjacent the V-shaped notch 3106 of the bottom portion 3102 are orifices 3110 that are aligned with openings 3112 disposed on each side of the V-shaped portion 3108 of the top portion 3104 of the break press 3100. Both the top and bottom portions 3104 and 3102 may be composed of 1018 steel or a suitable hard material as understood in the art to be harder than the components being altered. The V-shaped portion 3108 of the top portion 3104 is adapted to provide a cutting surface, such that when mechanical components designed to be alterable (e.g., plate 300) are placed between the extending V-shaped portion 3108 of the top portion 3104 and the V-shaped notch 3106 of the bottom portion 3102 of the break press 3100, a force may be translated directly onto the surface of the mechanical component for use in cutting and/or bending.

Alignment posts 3114, optionally, may extend from the bottom portion 3102 of the break press 3100 to facilitate alignment of the plate 300 or other component designed to be alterable. By engaging the openings 204 with the alignment posts 3114, the indentations 208 or other demarcation (e.g., opening 302) may be aligned with the V-shaped portion 3108 for altering (e.g., bending or cutting) of the plate 300 in relation to the indentations 208. In one embodiment, the alignment posts 3114 may be disposed in a fixed position. Alternatively/the alignment posts 3114 may be selectively moved to along the bottom portion 3102 of the break press 3100. While the use of alignment posts 3114 is useful for alignment of components designed to be alterable having openings, such as opening 204, other alignment mechanisms may be utilized, such as stops, bars, protrusions, demarcations, retractable elements, insertable elements, etc. Also, such alignment posts 3114 allow the break press 3100 to be used with other construction set components that are not designed to be alterable, but that also include openings, such as openings 204, and thereby sever the component in a predetermined relation to the openings. The V-shaped portion 3108 may optionally be configured to cut chamfers, curved or other additional shapes into the component being altered, so that, for example, when severing construction set components that are not designed to be alterable, substantially no sharp corners are formed.

The aligned openings 3112 of the top portion 3104 and orifices 3110 of the bottom portion 3102 of the break press 3100 may be further adapted to receive a screw therethrough; the orifices 3110 adapted to threadingly engage, the threads of the screws. To apply a desired severing or bending force, the screw inserted therein may be turned a sufficient number of turns until the desired bend or sever is achieved. As shown, the plate 300 may be aligned such that the indentations 208 are positioned along the V-shaped portion 3108 of the top portion 3104. When the top portion 3104 of the break press 3100 is pressed down into the bottom portion 3102 (e.g., through the tightening of screws), the plate 300 is bent or severed substantially between the indentations 208. By aligning the openings 302 substantially between the indentations 208, the plate 300 may have reduced resistance to bending to make the bending and/or severing easier and produce substantially no sharp edges if the severing stops at an opening 302. The top portion 3104 or bottom portion 3102 may have portions other than the V-shaped portions 3108 and 3106, respectively, to be provide for more severing or bending ability. For example, the V-shaped portion 3108 may have a rounded or squared bottom edge to provide for more bending ability.

Tools other than the break press 3100 may be utilized to bend and/or sever components designed to be alterable. For example, clippers, scissors, and the like may be used to cut along the axis extending from the indentations 208 and/or demarcations (e.g., indentations 208 and openings 302) of the components designed to be alterable provided in the construction set.

Referring now to FIG. 32, there is shown a wrench 3200 specifically adapted to manipulate mechanical components of the construction set. The wrench has a first, open end 3202 and a second closed end 3204, as do most wrenches known in the art. The open and closed ends 3202 and 3204 of the wrench 3200 are sized for gripping components provided in the construction set, such as the spacers 2302, during construction of a structure. A plurality of openings 3206, which are for aesthetic purposes, may be provided between the ends 3202 and 3204 of the wrench 3200, but also may be used to align the wrench 3200 with respect to other mechanical components having similar openings 3206. The wrench 3200 may be composed of a suitably hard material, such that the hardness of the wrench 3200 is greater than that of the mechanical components desired to be manipulated.

To provide coupling means to the various mechanical components of the system it should be appreciated that miscellaneous coupling or fastening components, including screws, bolts, nuts, snaps, rivets, etc., may be included with the construction set to make prototyping and construction a fast and easy process. Other fastening component variations may include hexagonal screws, lock nuts, Teflon nuts, nylon lock nuts, and washers. It should be understood that various fastener components accomplishing the same function as these described may be suitably substituted and/or included. The various fastening or coupling members may be sized accordingly to mate with the various openings of the various mechanical components described herein.

Business Methodologies

Figure 33:
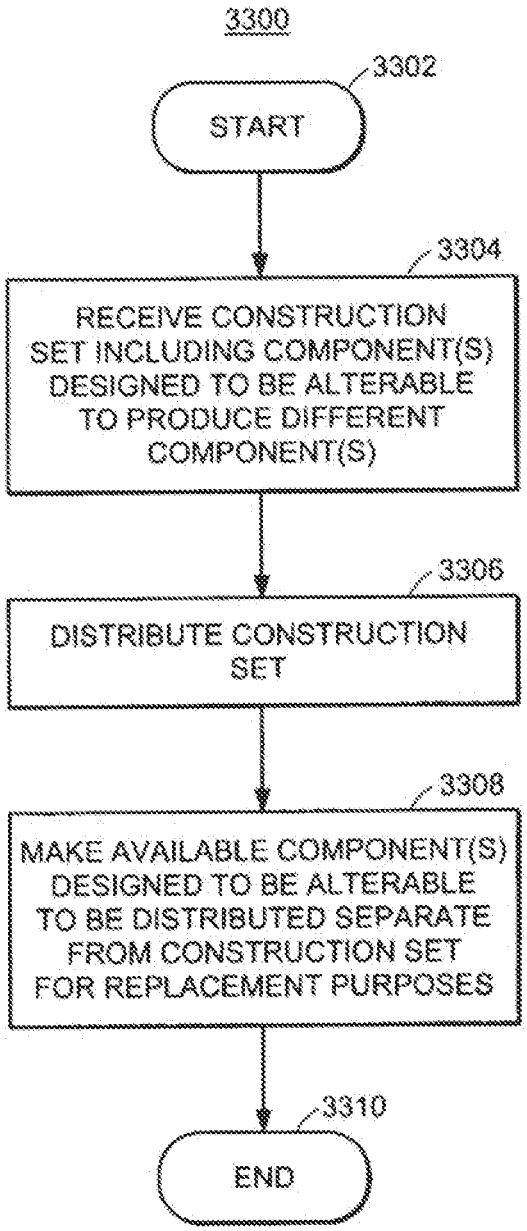
FIG. 33 is an exemplary flow chart describing distribution of complete construction sets having component(s) designed to be alterable and separate component(s) designed to be alterable for use in replacing the alterable components as desired in constructing a user-definable structure, such as that of FIG. 1.

FIG. 33 is an exemplary flow chart 3300 describing distribution of complete construction sets having component(s) designed to be alterable and separate component(s) designed to be alterable for use in replacing the alterable components as desired. The distribution process starts at step 3302. At step 3304, the construction set including component(s) designed to be alterable to be configured into different component(s) are received. In one embodiment, the construction set is manufactured by a company and received by the shipping department for distribution purposes, in another embodiment, a construction set enclosed in a shipping container (e.g., box) is received by a company from a manufacturer of the construction set ready for distribution, in yet another embodiment, components of the construction set are received and prepared for distribution by a company. At step 3306, the construction set is distributed. The distribution of the construction set may be direct to consumers or via a distribution channel, in the case of distributing the construction set direct to consumers, stores, mail order, network (e.g., the internet) marketing, or other forms of direct-to-consumer marketing and selling practices as known in the art may be utilized to distribute the construction. In the case of distributing the construction set via a distribution channel, selling directly to distribution outlets, such as retail stores, wholesale stores, etc, may be performed. Additionally, distribution of the construction set to mail order catalogs, distributors, or other "middle man" operation may be utilized.

At step 3308, the component(s) designed to be alterable (e.g., bar 200) of the construction set may be made available to be distributed separate from the construction set for replacement purposes. In making available the component(s) designed to be alterable, consumers and/or distribution channels may be notified of the availability of the components) designed to be alterable for purchasing, in one embodiment, the components) are provided in separate containers (e.g., box, bag, etc.) and distributed via the distribution channel(s) that the construction set is distributed. Alternatively, the component(s) and associated price(s) may be posted on a network or listed en a price sheet, catalog, flier, or other forms of notification to purchasers of the construction set. By making available the components) designed to be alterable, users who consume or use the components) designed to be alterable may purchase other ones to be used for constructing one or more structures. And, because the components) designed to be alterable may be altered to form different components, the user may construct structures of nearly any shape and size to perform nearly any function desired by the user.

Figure 34:
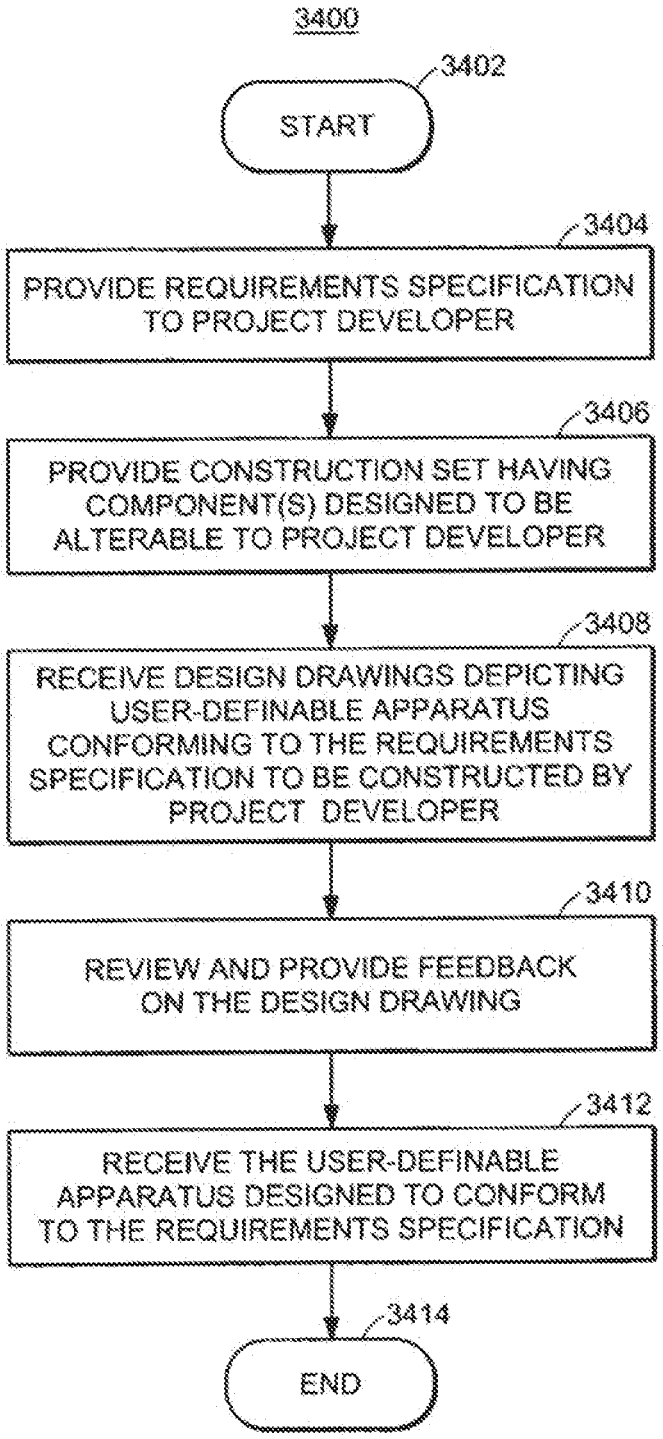
FIG. 34 is an exemplary flow diagram for teaching project development lessons utilizing the construction set having components designed to be alterable, such as the bar of FIG. 2A, according to the principles of the present invention.

FIG. 34 is an exemplary flow diagram 3400 for teaching project development lessons utilizing the construction set having components designed to be alterable, such as the bar of FIG. 2A, according to the principles of the present invention. The lessons may be meant to teach real-world project development issues. Such real-world project development issues may include design, manufacturing, cutting, waste management, cost issues, inventory control, monitoring usage of consumable components, and other real-world issues that arise in project development as experienced by engineers in industry.

The project development instruction starts at step 3402. At step 3404, a requirements specification may be provided to a project developer. The project developer may be a student, competitor, or other user who is to construct a user-definable structure that complies with the requirements specification utilizing the construction set having component(s) designed to be alterable. The requirements specification may be a formal document, non-formal document, or oral recitation of a function or act to be achieved by the user-deformable structure. One exemplary function may be picking up bails and placing them in a basket.

At step 3406, the construction set having component(s) designed to be alterable may be provided to the project, developer, in providing the construction set, a complete set may be provided. Alternatively, components from the construction set may be provided and the project developer may select the components desired to construct the user-definable structure in accordance with the requirements specification. In designing the user-definable structure conforming to the requirements specification, the project developer may generate design drawings depicting the structure prior to construction. The design drawings may be provided to an instructor for review at step 3408. At step 3410, the instructor may review and provide feedback on the design drawings.

At step 3412, the user-definable structure designed to conform to the requirements specification may be received by the instructor. In one embodiment, the instructor receives and grades the user-definable structure based, on functionality, appearance, dimensions, operability, and/or other visual and functional aspects. Alternatively and/or additionally, the user-definable structure may be received by the participation of the structure in an event, such as a contest, to operate in accordance with the requirements specification. Based on the operation of the user-definable structure in the event, the project developer may receive a score, grade, or other merit based value. The process ends at step 3414.

In addition to teaching real-world problem solving as described in connection with FIG. 34, the principles of the present invention may be used to further education of students with respect to the construction of electrical, mechanical and electromechanical devices. To assist with teaching students, an instructor may utilise components of the construction set to develop a curriculum in various academic fields, such as science, mathematics, physics and the like. Based on the components in the construction set, the curriculum may provide guidelines for developing mathematical, scientific or physic formulae to satisfy a problem. Based on results of the calculations, the students may select parts from the construction set as described in the curriculum for accomplishing objectives in furtherance of solving the problem. Instructions for building different structures may be provided in the curriculum. After selection of the components, the students may then build the desired prototype and attempt to provide a working solution to the problem. If unsuccessful, the teacher may suggest other formulae in accordance with the associated curriculum to develop alternate solutions to the problem.

Use of a construction set provided in accordance with the invention also can be used in teaching material usage, inventory, and selection of components. By providing a set number of components within a kit, the user may determine the optimum usage of the materials both in selecting the proper component for the task and in altering components to produce additional components. For example, the user may choose between using an existing component or modifying other components to accomplish a given task while weighing the need for a specific configuration against its impact on the inventory of similar component or other components that are alterable to achieve the same task, further, when altering a component, the user may learn to optimize usage of given component to achieve the desired configuration while at the same time minimizing wastage.

Figure 35:
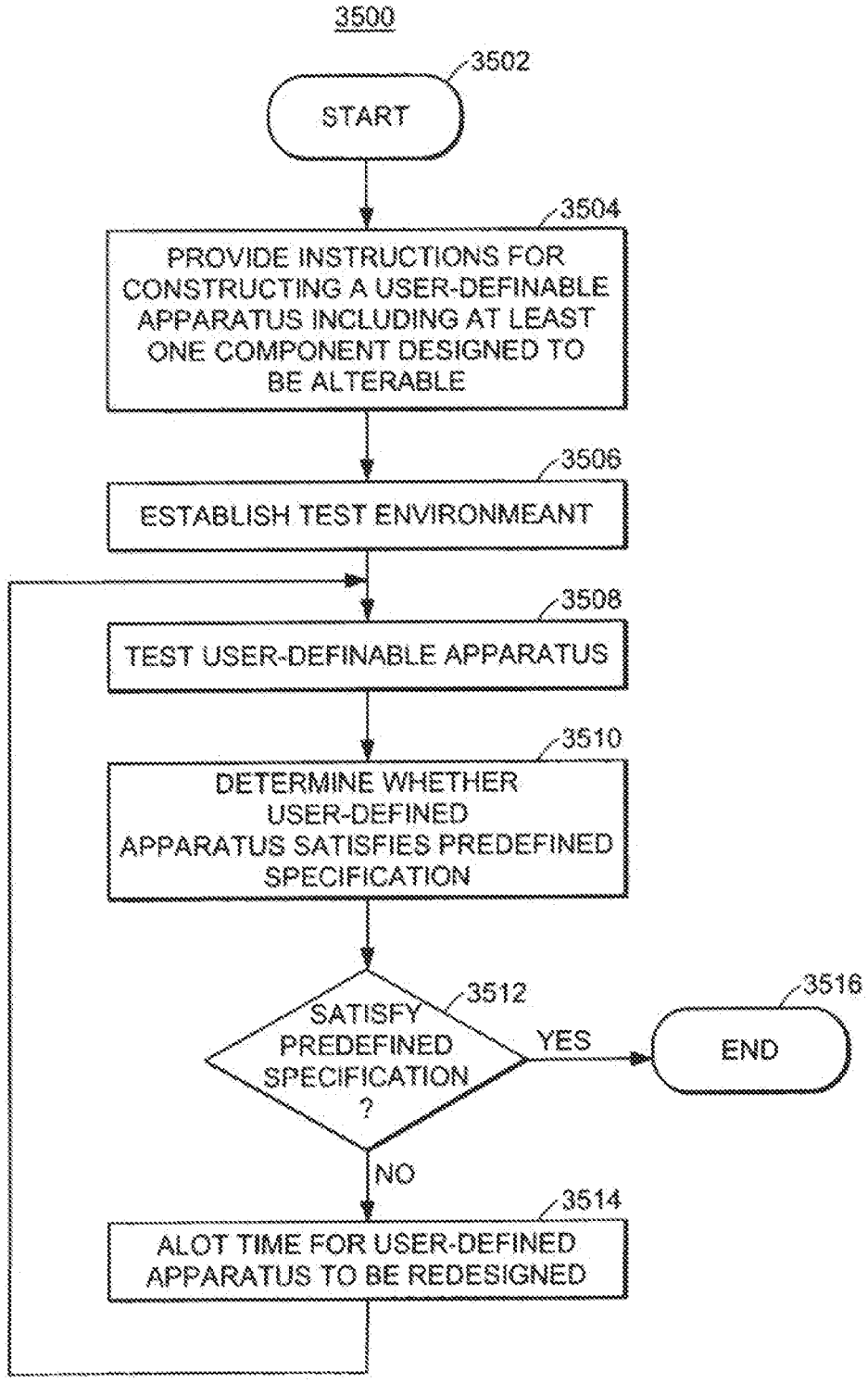
FIG. 35 is an exemplary embodiment for teaching production cycle project development utilizing a construction set having at least one construction set component designed to be alterable for constructing a user-definable apparatus 100, such as that of FIG. 1.

FIG. 35 is an exemplary embodiment for teaching production cycle project development utilising a construction set having at least one construction set component designed to be alterable for constructing a user-definable apparatus 100, such as that of FIG. 1. The production cycle teaching process starts at step 3502. At step 3504, instructions may be provided for constructing the user-definable apparatus including at least one construction set component designed to be alterable. The instructions may include requirements to construct an apparatus to perform a particular task (e.g., picking up a hall). Alternatively and/or additionally, the instructions may include specifications of maximum size and/or weight. It should be understood that other instructions may be provided to challenge the designer to be more or less creative in the process of designing the user-definable apparatus. A variety of project development activities may also be monitored. Such project development activities may include procurement, management of material, quality control, and time management. By monitoring these activities, feedback may be provided to enhance the real-world skills of the designer of the user-definable apparatus.

To allow the user-defined apparatus to be tested to predefined specifications, a test environment may be established at step 3506. In one embodiment, the test environment may be formed on top of a desk or fable and optionally include other objects that the user-defined apparatus is to engage. Alternatively, the test environment may be formed on a floor. At step 3508, the user-defined apparatus may be tested in the test environment to verify that the predefined specifications are satisfied. At step 3510, a determination is made as to whether the user-defined apparatus satisfies the predefined specifications. The predefined specifications may include time limits or efficiency for performing a task. The predefined specification also may include size, weight, shape, creativeness, ingenuity, part count, modified component count, or other objective and subjective criteria.

At step 3512, it is determined if the user-defined apparatus satisfied the predefined specification, if the user-defined apparatus did not satisfy the predefined specification, then at step 3514, time is allotted for the user-defined apparatus to be re-designed. Re-testing of the user-defined apparatus may be performed at stop 3508 to determine if the re-design improved the user-defined apparatus with respect to the predefined specification. If the user-defined apparatus satisfies the predefined specification at step 3512, then the process ends at step 3516.

The teaching of real world engineering is becoming more important. Engineers are required to juggle an enormous collection of design, safety, manufacturability, cost, technology, risk, and usability requirements. In addition, the fabrication cycle of building a prototype or production apparatus involves aspects of production tools and technology, operator training, parts inspection and rejection, and so on. The full set of these requirements is never fully understood even by experienced engineers or project managers, however, the ability to look at a variety of requirements that are often at odds with one another is still to be taught.

College design competitions are designed to teach engineers to understand some of these issues. These competitions have a variety of styles and demand application engineering talents of the mechanical, electrical, and/or software designers to succeed. During the process, the engineers learn more than just engineering.

By incorporating aspects of design competitions with a construction set for constructing a user-definable apparatus, the need for significant and detailed engineering talents can be eliminated, and the real world aspects of problem solving can still be addressed. The design competition can now be taught at earlier educational levels. By students performing the seemingly enjoyable task of building a robot, to compete against others, a long list of problem solving, engineering, and production problems may be encountered.

The following is an exemplary list of the issues that may be experienced and taught with the use of this method for teaching production cycle project development TABLE 3 shows major subjects that are addressed by teaching utilizing the principles of the present invention. These major topics address a variety of management and planning issues that surround an engineering development project that students may encounter in the real world.

TABLE 3

| Major Subjects Addressed by Teaching Product Cycle Project Development |
|---|
| Ida brainstorming |
| Concept development and refinement |
| Prototype design and fabrication |
| Engineering (electrical, mechanical, and software) |
| System engineering |
| Project management |
| Cost management |
| Program or product management |
| Component fabrication |
| Product assembly |
| Product testing |
| Product redesign and product improvement |
| Product maintenance and repair |

TABLE 4 is an exemplary list of additional topics addressed by teaching the product cycle project development using the construction set having components designed to be alterable for constructing a user-definable apparatus. The topics are relevant to students learning the details of an engineering construction project.

| Additional Topics Addressed by Teaching Product Cycle Project Development |
|---|
| Time management |
| Material usage |
| Parts inspection and tolerances |
| Parts scrapping and rebuilding |
| How design affects assembly time |
| How design affects maintenance and repair |
| Benefits of a simple design |
| Problems with complex designs |
| Manufacturing tool usage and safety |
| Importance of documentation and document control |

As will be recognized by those skilled in the art, the innovative concepts described in the present application can be modified and varied over a wide range of applications. Accordingly, the scope of patented subject matter should not be limited to any of the specific exemplary teachings discussed, but is instead defined by the following claims.

What is claimed is:

1. A construction locking component for use with a construction set for constructing a user-definable apparatus, the construction set including a construction member having at least two non-aligning openings, each opening operable to receive a drive shaft and each opening being sized to allow the drive shaft to rotate therein without rotating the construction member, the locking component comprising:

a body having at least two non-aligning apertures substantially coinciding with the two non-aligning openings on the construction member, and wherein one of the two apertures is sized to receive and fixably engage the drive shaft such that rotation of the drive shaft through the construction member opening causes rotation of the locking component; and a fastener being sized to insert through one of the two apertures on the body and one of the coinciding openings on the construction member such that the body and the construction member are locked to each other, whereby rotation of the drive shaft causes rotation of the body and the construction member.

2. The construction set component of claim 1, wherein the locking component has demarcations operable to facilitate reconfiguration of the lock member.

3. The construction set component of claim 1, wherein the locking component has at least one protrusion operable to engage an opening in the construction member and align the locking component in relation to the body member.

4. A construction set comprising a plurality of components for constructing a user-definable apparatus, including a drive shaft, the set further comprising:

a construction member having at least two non-aligning openings, each opening operable to receive the drive shaft and each opening being sized to allow the drive shaft to rotate therein without rotating the construction member; and a locking member having at least two non-aligning apertures and the locking member being configured to abut the construction member such that the at least two non-aligning apertures substantially coincide with the two non-aligning openings on the construction member, and wherein one of the two apertures is sized to receive and fixably engage the drive shaft such that rotation of the drive shaft causes rotation of the locking member, the locking member further having at least one protrusion extending away from the locking member into one of the openings on the construction member, whereby when the locking member abuts the construction member such that the at least two non-aligning apertures substantially coincide with the two non-aligning openings and the drive shaft is inserted there through, rotation of the drive shaft cause rotation of both the construction member and the locking member.

5. The set of claim 4 further comprising: a fastener being sized to insert through one of the two apertures on the locking member and one of the coinciding openings on the construction member such that the locking member and the construction member are locked to each other.

6. The set of claim 4, wherein a second aperture of the two non-aligning apertures defined on locking member is sized to receive the drive shaft and allow the drive shaft to rotate therein without rotating the locking member.

7. The set of claim 6 further comprising: an insert member having an exterior surface to engage an interior surface of the second aperture and prevent rotation of the insert member and the insert member further having a shaft engaging opening to receive and fixably engage the drive shaft such that rotation of the drive shaft causes rotation of the insert member and thereby rotation of the locking member.

* * * * *